US008256028B1

(12) United States Patent
Ibon et al.

(10) Patent No.: US 8,256,028 B1
(45) **Date of Patent: *Sep. 4, 2012**

(54) MATCHED PAIR OF PROTECTIVE BASEBALL BATTING GLOVES FOR RIGHT HANDED AND LEFT HANDED BATTERS TO PROTECT THE SIDE OF THE HAND AND THE WRIST FACING A PITCHER WITH PROTECTIVE SHOCK ABSORBING MEMBERS ON THE EXTERIOR OF THE GLOVE

(75) Inventors: James Ibon, Porter Ranch, CA (US); Steven J. Behrens, Costa Mesa, CA (US); Jack A. Kasarjian, Camarillo, CA (US); Scott Boyer, Valencia, CA (US)

(73) Assignee: XProTex Sports Group Worldwide, Inc., Camarillo, CA (US)

( * ) Notice: Subject to any disclaimer, the term of this patent is extended or adjusted under 35 U.S.C. 154(b) by 403 days.

This patent is subject to a terminal disclaimer.

(21) Appl. No.: 12/456,289

(22) Filed: Jun. 15, 2009

(51) Int. Cl.
*A41D 19/00* (2006.01)

(52) U.S. Cl. ..... 2/161.1

(58) Field of Classification Search ..... 2/160, 161.1, 2/161.6, 162, 163; 473/205, 450, 458, 464
See application file for complete search history.

(56) References Cited

U.S. PATENT DOCUMENTS 2,975,429 A 3/1961 Newman
3,251,076 A * 5/1966 Burke ..... 428/116
3,862,919 A 1/1975 Nitzsche et al.
4,700,405 A * 10/1987 Sternberg ..... 2/161.1
4,864,659 A 9/1989 Morris
4,911,433 A 3/1990 Walker
4,983,642 A 1/1991 Nakano et al.
5,090,053 A 2/1992 Hayes
5,107,544 A 4/1992 Capatosto
5,345,609 A * 9/1994 Fabry et al. ..... 2/20
5,487,188 A 1/1996 Micheloni et al.
5,498,640 A 3/1996 Witt et al.
5,580,917 A 12/1996 Maciejewski et al.
5,720,047 A 2/1998 Spitzer
5,898,938 A 5/1999 Baylor et al.
5,924,137 A 7/1999 Gold
5,987,646 A * 11/1999 Bolmer ..... 2/161.1
6,119,271 A 9/2000 Byon
6,305,022 B1 10/2001 Oomura
6,389,601 B2 5/2002 Kleinert
6,425,134 B1 * 7/2002 Huang ..... 2/20
6,701,529 B1 3/2004 Rhoades et al.
6,715,152 B2 4/2004 Mazzarolo
6,772,441 B2 8/2004 Lucas, Jr.
6,913,802 B1 7/2005 Plant
(Continued)

*Primary Examiner* — Katherine Moran
(74) *Attorney, Agent, or Firm* — Thomas I. Rozsa

(57) ABSTRACT

The present invention is a novel protective batting glove which is used specifically for protecting the most vulnerable parts of a batter's hands and wrists when the batter is standing at home plate and is gripping the end of a baseball bat and awaiting the arrival of a baseball which is thrown by the pitcher. The invention comprises a unique protective system of a design of a matched pair of batting gloves with one matched pair designed for a right handed batter and one matched pair designed for a left handed batter. For each matched pair of batting gloves, impact and shock absorbing material is incorporated onto selected portions of the exterior of the glove where the grip on the bat causes the hand to be most exposed to a pitch thrown at the batter.

50 Claims, 33 Drawing Sheets

U.S. PATENT DOCUMENTS

| | | | |
|---|---|---|---|
| 6,961,960 | B2 | 11/2005 | Gold |
| 6,969,548 | B1 | 11/2005 | Goldfine |
| 7,000,256 | B2 | 2/2006 | Kleinert |
| 7,000,259 | B2 | 2/2006 | Matechen |
| 7,007,308 | B1 | 3/2006 | Howland et al. |
| 7,100,216 | B2 | 9/2006 | Matechen et al. |
| 7,171,697 | B2 | 2/2007 | Vito et al. |
| 2004/0173422 | A1 | 9/2004 | Deshmukh et al. |
| 2005/0160626 | A1 | 7/2005 | Townsend |
| 2007/0029690 | A1 | 2/2007 | Green et al. |
| 2007/0152117 | A1 | 7/2007 | Byrd |
| 2007/0226873 | A1 | 10/2007 | Mattesky |
| 2008/0000009 | A1 | 1/2008 | Kogawa et al. |
| 2008/0078011 | A1 | 4/2008 | Kleinert |
| 2009/0113592 | A1* | 5/2009 | Iwata et al. ..... 2/19 |

* cited by examiner

MATCHED PAIR OF PROTECTIVE BASEBALL BATTING GLOVES FOR RIGHT HANDED AND LEFT HANDED BATTERS TO PROTECT THE SIDE OF THE HAND AND THE WRIST FACING A PITCHER WITH PROTECTIVE SHOCK ABSORBING MEMBERS ON THE EXTERIOR OF THE GLOVE

BACKGROUND OF THE INVENTION

1. Field of the Invention

The present invention relates to the field of protective gloves which are worn by an athlete while playing a sporting event. In particular, the present invention relates to the field of baseball batting gloves which are used by a baseball player while gripping a baseball bat during the time the player is at the plate to hit a baseball thrown at the player by a pitcher.

2. Description of the Prior Art

In general, protective material incorporated into wearing apparel and protective material incorporated in athletic gloves are known in the prior art. The following 23 patents and Published Patent Applications are relevant to the field of the present invention.

1. U.S. Pat. No. 3,862,919 issued to Siegfried Nitzsche et al. and assigned to Wacker-Chemie GmbH on Jan. 28, 1975 for "Oranopolysiloxane Compositions Having Resilient Properties" (hereafter the "Nitzsche Patent");

2. U.S. Pat. No. 4,983,642 issued to Akio Nakano et al. and assigned to Shin-Etsu Chemical Co., Ltd. on Jan. 8, 1991 for "Foamable Silicone Rubber Composition And Foamed Silicone Rubber Body Therefrom" (hereafter the "Nakano Patent");

3. U.S. Pat. No. 5,090,053 issued to Harry D. Hayes and assigned to Dalton Enterprise on Feb. 25, 1992 for "Composite Shock Absorbing Garment" (hereafter the "Hayes Patent");

4. U.S. Pat. No. 5,498,640 issued to Michael Witt et al. and assigned to BASF Aktiengesellschaft on Mar. 12, 1996 for "Expandable Thermoplastic Polymers Containing Organic Boron-Silicon Compounds, And A Process For Their Preparation" (hereafter the "Witt Patent");

5. U.S. Pat. No. 5,580,917 issued to Jeremi Maciejewski et al. on Dec. 3, 1996 for "Hydrostatically Damping Shock And Vibration Energy Absorbing Non-Vulcanizable Silicone Elastomer" (hereafter the "Maciejewski Patent");

6. U.S. Pat. No. 6,701,529 issued to Lawrence J. Rhoades et al. and assigned to Extrude Hone Corporation on Mar. 9, 2004 for "Smart Padding System Utilizing An Energy Absorbent Medium And Articles Made Therefrom" (hereafter the "Rhoades Patent");

7. United States Published Patent Application No. 2004/0171321 to Daniel Hames Plant on Sep. 2, 2004 for "Flexible Energy Absorbing Material And Methods Of Manufacture Thereof" (hereafter the "Plant Published Patent Application");

8. United States Published Patent Application No. 2004/0173422 to Suraj S. Deshmukh et al. on Sep. 9, 2004 for "Fluid-Filled Cellular Solids For Controlled" (hereafter the "Deshmukh Published Patent Application");

9. U.S. Pat. No. 6,913,802 issued to Daniel James Plant on Jul. 5, 2005 for "Energy Absorbing Protective Member" (hereafter the "Plant Patent");

10. United States Published Patent Application No. 2005/0160626 to Herbert E. Townsend on Jul. 28, 2005 for "Shoe With Cushioning And Speed Enhancement Midsole Components And Method For Construction Thereof" (hereafter the "Townsend Published Patent Application");

11. U.S. Pat. No. 7,000,259 issued to John M. Matechen and assigned to Impact Innovative Products, LLC on Feb. 21, 2006 for "Sports Glove With Padding" (hereafter the "'259 Matechen Patent");

12. U.S. Pat. No. 7,100,216 issued to John M. Matechen et al. and assigned to Impact Innovative Products, LLC on Sep. 5, 2006 for "Garment With Energy Dissipating Conformable Padding" (hereafter the "'216 Matechen Patent");

13. U.S. Pat. No. 7,171,697 issued to Robert A. Vito et al. and assigned to Sting Free Company on Feb. 6, 2007 for "Vibration Dampening Material And Method Of Making Same" (hereafter the "Vito Patent");

14. United States Published Patent Application No. 2007/0029690 to Philip Green et al. on Feb. 8, 2007 for "Energy Absorbing Blends" (hereafter the "Green Published Patent Application");

15. United States Published Patent Application No. 2007/0152117 to Randel Louis Byrd on Jul. 5, 2007 for "Viscoelastic Mounting Device" (hereafter the "Byrd Published Patent Application");

16. World Intellectual Property Organization patent No. WO 2007/102020 issued to Graham Budden et al. and assigned to Dow Corning Corporation on Sep. 13, 2007 for "Impregnated Flexible Sheet Material" (hereafter the "Budden WIPO Patent").

17. U.S. Pat. No. 4,911,433 issued to Walker on Mar. 27, 1990 for "Weighted Athletic Glove" (hereafter the "Walker Patent");

18. U.S. Pat. No. 5,345,609 issued to Fabry on Sep. 13, 1994 for "Protective Glove Having Closed and Isolated Fluid Filled Cells" (hereafter the "Fabry Patent");

19. U.S. Pat. No. 6,105,162 issued to Douglas on Aug. 22, 2000 for "Hand Protector" (hereafter the "Douglas Patent");

20. U.S. Pat. No. 6,119,271 issued to Byron on Sep. 19, 2000 for "Golf Glove" (hereafter the "Byron Patent").

21. U.S. Pat. No. 6,969,548 issued to Goldfine on Nov. 29, 2005 for "Impact Absorbing Composite" (hereafter the "Goldfine Patent");

22. U.S. Pat. No. 6,961,960 issued to Gold on Nov. 8, 2005 for "High Strength Impact Resistant Hand Protector" (hereafter the "'960 Gold Patent").

23. U.S. Pat. No. 2,975,429 issued to Donald J. Newman on Mar. 21, 1961 for "Golf Glove" (hereafter the "Newman Patent");

24. U.S. Pat. No. 4,864,659 issued to Stephen M. Morris and assigned to GenCorp Inc. on Sep. 12, 1989 for "Sports Glove" (hereafter the "Morris Patent");

25. U.S. Pat. No. 5,107,544 issued to Marc A. Capatosto on Apr. 28, 1992 for "Ice Hockey Goalie Glove Construction" (hereafter the "Capatosto Patent");

26. U.S. Pat. No. 5,487,188 issued to Walter Micheloni et al. on Jan. 30, 1996 for "Glove With Means For Protecting The Ligaments And Articulations Of The Hand" (hereafter the "Micheloni Patent");

27. U.S. Pat. No. 5,720,047 issued to Thomas Spitzer and assigned to Uhlsport GmbH on Feb. 24, 1998 for "Sports Glove, In Particular A Goalie Glove" (hereafter the "Spitzer Patent");

28. U.S. Pat. No. 5,898,938 issued to Don Edward Baylor et al. on May 4, 1999 for "Hand Protecting Device" (hereafter the "Baylor Patent");

29. U.S. Pat. No. 5,924,137 issued to Danny Gold on Jul. 20, 1999 for "Finger End Protection Construction" (hereafter the "'137 Gold Patent");

30. U.S. Pat. No. 6,305,022 issued to Noboru Oomura et al. and assigned to Mizuno Corporation on Oct. 23, 2001 for "Glove For Baseball Or Softball" (hereafter the "Oomura Patent");

31. U.S. Pat. No. 6,389,601 issued to James Kleinert and assigned to Hillerich & Bradsby Co., on May 21, 2002 for "Batting Glove" (hereafter the "'601 Kleinert Patent");

32. U.S. Pat. No. 6,715,152 issued to Giovanni Mazzarolo and assigned to Alpinestars SpA on Apr. 6, 2604 for "Motorcycling Glove" (hereafter the "Mazzarolo Patent");

33. U.S. Pat. No. 6,772,441 issued to Alfred W. Lucas, Jr. on Aug. 10, 2004 for "Soccer Goalkeeper Glove" (hereafter the "Lucas Patent");

34. U.S. Pat. No. 7,000,256 issued to James M. Kleinert and assigned to Hillerich & Bradsby Co. on Feb. 21, 2006 for "Work Glove" (hereafter the "'256 Kleinert Patent");

35. U.S. Pat. No. 7,007,308 issued to Charles A. Howland et al. and assigned to Warwick Mills, Inc. on Mar. 7, 2006 for "Protective Garment And Glove Construction And Method For Making Same" (hereafter the "Howland Patent");

36. United States Published Patent Application No. 2007/0226873 to Henry Mattesky on Oct. 4, 2007 for "Stretchable, Multi-Layered Gloves" (hereafter the "Mattesky Published Patent Application");

37. United States Published Patent Application No. 2008/0000009 to Daisuke Kogawa et al. on Jan. 3, 2008 for "Glove" (hereafter the "Kogawa Published Patent Application");

38. United States Published Patent Application No. 2008/0078011 to James M. Kleinert on Apr. 3, 2008 for "Glove" (hereafter the "Kleinert Published Patent Application");

39. World Intellectual Property Organization Patent No. WO 2006/068381 issued to Dong-suk Song and assigned to Hyong-choi Kim on Jun. 29, 2006 for "Hand Protection Device For Fighting Games" (hereafter the "Song WIPO Patent");

40. Patent Abstract of Japan No. 2008007904 issued to Usami Kimie and assigned to Eito K K on Jan. 17, 2008 for "Business-Use Glove" (hereafter the "Kimie Patent Abstract of Japan").

The Nitzsche Patent discloses a composition having a high degree of elasticity under suddenly applied stress. The composition is used to absorb impact such as couplings, door closing devices, and re-coiled dampers. Also, it can also be placed in use with physical therapy devices.

The Nakano Patent is a chemical composition patent which goes into a detailed chemical description of the product.

The Hayes Patent discloses a composite shock absorbing material for use in ballistic projectile protective garments. This is best illustrated in FIG. 1. FIG. 5 is a transverse, cross-sectional view, which illustrates the internal construction of each of the elongated strands forming them into composite shock absorbing materials 10'. The inner-core 18' is preferably filled with a liquid, although a gas may also be employed within the scope of the invention. The preferred material is polydimetysil oxane, which is commonly called fluid silicon. Claim 1 is a fairly broad claim and reads: "A composite shock absorbing material for use in protective garments, comprising: an open mesh array formed by a plurality of intersecting interconnected strands, wherein each of said strands has a cores surrounded by a visco-elastic polymer material, the cores of said strands being formed by a liquid material."

The Witt Patent discloses an elastic energy absorbing chemical patent. It's very broad claim 1 claims, "an expandable thermoplastic polymer in particle form, comprising a) at least one boron-siloxane elastomer, b) at least one thermoplastic polymer, and c) a blowing agent."

The Maciejewski is a chemical patent and discloses a hydrostatically damping, shock and vibration energy absorbing, non-vulcanisable silicone elastomer comprised of a methylphenylsilicone polymer which has a matrix of a condensation of polydimethyl- or/and methylhydrosiloxane diols condensed with reactive compounds of silicon, boron or nitrogen giving the viscous polymer an appropriate elasticity coefficient by forming mobile hydrogen bonds. The elastomer according to the invention also contains fillers and lubricants.

The Rhoades Patent discloses a smart padding system utilizing an energy absorbing medium and articles made therefrom. The invention relates to an energy absorbent medium which is compliant and conformable in the absence of an applied force, and stiffens in response to the rate of an applied force to dissipate energy. The medium comprises a blend of polymer and lubricant incompatible with the polymer to produce a conformable absorbent which exhibits dilatant (shear thickening) characteristics under high rates of force or stress. The polymer has reformable sacrificial chemical bonds which are broken under a high rate of deformation and which reform under static conditions. Suitable polymers for the invention include polyborosiloxanes. Applications for the medium include absorbent for sports padding, athletic equipment, motor vehicle seats, bulletproof vests, medical equipment, industrial equipment, weaponry, and playing fields. This is incorporated into gloves as set forth in FIG. 4(*a*) and FIG. 4(*b*). A suitable polymer is one that exhibits hydrogen bonding. These hydrogen bonds result from dipole interaction between polymer chains. The hydrogen bonds formed are not permanent covalent bonds, but are liable or reformable bonds which provide the dilatant behavior characteristic of polyborosiloxanes. Suitable fillers are typically inert materials which range from free-flowing to caking powders, microspheres, pulp, fibers, microcellular foams, closed-cell foams and other materials. An example of an energy absorbent medium made in accordance with this invention is a 100 pph (parts per hundred) of polyborosiloxane polymer, 60 pph of a metal soap gelled paraffinic lubricant, and 20 pph of plastic microspheres. This is equivalent to a composition of 60%, 30%, and 10% respectively. This inherent property of the composition is ideal for use as a shock absorber or energy attenuating pad for protection of the human body as well as other objects. The shock absorbing material composition is suitable for packaging or encapsulation is a containment or envelop for use in high impact energy absorbent or protective gear.

The Plant Published Patent Application discloses a flexible energy absorbing sheet material in which a dilatant material (6) is impregnated into or supported by a resilient carrier (1). The dilatant material remains soft until it is subjected to an impact when its characteristics change rendering it temporarily rigid, the material returning to its normal flexible state after the impact. The carrier can be a spacer fabric, a foam layer or modules or threads of dilatant material contained between a pair of spaced layers. Methods of manufacturing the energy absorbing sheet are also disclosed. As illustrated in FIG. 25, the materials are intended to be incorporated into shoes. The energy absorbing dilatent compound material within the modules absorbs the impact force and spreads the load thereof during the impact. The preferred material is a dimethyl-siloxane-hydro-terminated polymer such as the material sold by Dow Corning under the catalogue number 3179 or a lightweight version thereof containing Duolite spheres. The siloxane groups in the preferred borosiloxane copolymers are of the formula —$(OSiR_1R_2)$—, wherein $R_1$ and $R_2$ can be the same or different and each, independently, can be substituted or unsubstituted alkyl or aryl group. Preferred such alkyl groups contain 1 to 6 carbon atoms and, more preferably, 1, 2, 3, 4, or 5 carbon atoms. The preferred substituted alkyl groups are hydrofluoroalkyl groups. In preferred embodiments, one or both of $R_1$ and $R_2$ is a methyl, phenyl, or 1,1,1, trifluoropropyl group. Preferred siloxane groups include the following: —(OSiMePh)—, —(OSiMe$_2$)—, —(OSiPh$_2$)— and —(OSi(CH$_2$CH$_2$CF$_3$)Me)—; wherein Me is a methyl group and Ph is a phenyl group. The preferred borosiloxane copolymers for use in the present invention are those included in Dow Corning 3179 Dilatant Compound and Dow Corning) Q2-3233 Bouncing Putty.

The Deshmukh Patent Published Patent Application discloses an impact absorber using an energy-absorbing, fluid-impregnated material consisting of a porous interconnected network of solid material forming edges and faces of cells, preferably an open-cell reticulated or partially closed-cell foam, or formed form fibers or other cellular solids. The matrix is impregnated with a field responsive fluid such as a magneto- or electro-rheological fluid, or with a shear-rate responsive fluid such as a dilatant (shear-thickening) fluid. The material is placed under compression during impact, and may be housed within a cylinder and compressed by a piston. The stiffness of the composite material consisting of a matrix filled with a field responsive fluid can be controlled by varying the field intensity and spatial gradients of the applied field to vary the rheological properties of the fluid. In one embodiment as shown in FIG. 11, it is used for a passenger head rest. Claim 1 reads as follows: "an impact absorber comprising composite material consisting of a cellular solid or fibrous matrix, impregnated with a fluid, that stiffens under predetermined conditions, and means for compressing said composite material in response to an impact to dissipate the energy of said impact.

The Plant Patent discloses an energy absorbing protective member primarily for use as an energy absorbing pad for incorporation into garments to protect the wearer against accidental impacts. The member comprises a putty-like energy absorbing material (2) encapsulated in a flexible envelope (3, 4). The energy absorbing material is normally soft and flexible but changes to become temporarily rigid when an impact force is applied thereto, thereby absorbing the impact energy, the material returning to its normal flexible condition after the impact. The energy absorbing member preferably comprises a series of connected corrugations to increase its energy absorbing properties. The preferred material is a Dimethyl siloxane hydroterminated polymer such as the material sold by DOW CORNING under their Catalogue or Trade number 3179. The unique multi-layer energy absorbing member can flex with movement of the body when protection is not needed and thus is very comfortable to wear. When impacted however, the strain rate sensitive polymer in the energy absorbing member reacts instantaneously to form a semi-rigid structure that absorbs and dissipates the blow giving maximum protection.

The Townsend Published Patent Application discloses a cushioning member inside of a shoe to absorb shock. In the preferred embodiment, the dilatant compound is derived from a mixture of dimethyl siloxane, hydro-terminated polymers with boric acid, Thixotrol ST brand organic rheological additive manufactured by Elementis Specialties, Inc., polydimethysiloxane, decamethyl cyclopentasiloxane, glycerine, and titanium dioxide. This compound is sold by Dow Corning as Dilatant Compound No. 3179. Other dilatant compounds that could be used are available on the market and described in the prior art. This is primarily focusing on shock absorbing materials in a runner's shoe.

The '259 Matechen Patent discloses a sports glove padding. Specifically, it discloses a vibration dissipating sports glove for use in holding a bat while hitting a baseball having an energy-absorbing front pad between the index finger and the thumb. The glove also has a back padding covering some portions of the metacarpal portion of the hand and may furthermore have knuckle padding for covering the middle knuckle of each of the fingers. By using padding in a discriminate fashion, the glove maintains adequate flexibility and feel while, at the same time, protects the batter from bat-induced vibration, and furthermore, from pitched balls which may hit the batter's hand. Additionally, the front pad conforms between the batter's hand and the bat to provide the batter a more secure grip upon the bat.

As illustrated in FIG. 3, the pad 180 may be comprised of energy dissipating conformable media 182, such as polyborosiloxane, encapsulated in a non-porous flexible sheath 184, such as PVC or polyurethane having a thickness of approximately 12 gauge. A second embodiment of the invention further includes back padding 190 at the back portion 170 of the glove 100, whereby the back padding 190 covers only the region defined by the top of the metacarpal bones of the fingers and, in particular, covers portions of the index finger metacarpal bone 32, middle finger metacarpal bone 42, ringer finger metacarpal bone when the glove 100 is positioned upon the wearer's hand. The back padding 190 may be comprised o fan energy dissipating conformable media encapsulated in a flexible layer. As an example, the media may be polyborosiloxane while the flexible layer may be PVC or polyurethane having a thickness of approximately 12 gauge. The back padding 190 may be comprised of a single flat pad, as illustrated in FIG. 5. There is no padding on the side of the hand adjacent the metacarpal bone aligned with the pinkie finger. In addition, no wrist bones are protected.

The '216 Matechen Patent discloses a garment which has a piece of clothing with at least one pad of conformable, energy dissipating media. The pad is positioned at a location on the clothing of the wearer to dissipate the energy resulting from a sudden impact at that location. The pad may be retained against the garment by a connector attached to the surface of the clothing or may be secured within a pocket on the garment. Additionally, the pad may be used in conjunction with the hard shell padding. The padding material is light weight, viscoelastic polymer that exhibits fluid-like characteristics in the absence of a sudden impact, and acts as a solid when subjected to a sudden impact. Polyborosiloxane is a preferred polymer material. Directing attention to FIGS. 2-4, the pad 20 is comprised of a conformable media 50 confined within an encasement 55. In a preferred embodiment, the media is a polymer composition such as polyborosiloxane.

The Vito Patent is a vibration dampening material and a method of making it. The material is incorporated into numerous products including the handle of the baseball bat in the area where the bat is gripped. The preferred cross-section of the glove panels 305 is also shown in FIG. 23. FIG. 35 illustrates a glove 436 suitable for both baseball and softball that uses panels 305 to provide protection to a palm area 437. FIG. 36 illustrates a weightlifting glove 438 having panels 305 of the material 10 thereon. 9 illustrates a golf glove 446 having at least one panel 305 thereon. FIG. 40 illustrates the type of glove 448 used for rope work or by rescue services personnel with panels 305 of the material 10 of the present invention. FIG. 41 shows a batting glove 450 with panels 305 thereon.

The Green Published Patent Application discloses a composite material which is elastic, which exhibits a resistive load under deformation, which is unfoamed or foamed, comminuted or uncomminuted and which comprises I) a first polymer-based elastic material and II) a second polymer-based material, different from I), which exhibits dilatancy in the absence of I) wherein II) is entrapped in a solid matrix of I), the composite material being unfoamed or, when foamed, preparable by incorporating II) with I) prior to foaming. Any polymer-based material, different from I), which exhibits dilatancy and can be incorporated into the chosen elastic constituents) of first material I) may be used as second material II). By a polymer-based material which exhibits dilatancy is meant a material in which the dilatancy is provided by one or more polymers alone or by a combination of one or more polymers together with one or more other components, e.g. finely divided particulate material, viscous fluid, plasticiser, extender or mixtures thereof, and wherein the polymer is the principal component. In one preferred embodiment, the polymer comprising the second material II) is selected from silicone polymers exhibiting dilatant properties. For example, the dilatant may be selected from filled or unfilled polyborodimethylsiloxanes (PBDMSs) or any number of polymers where PBDMS is a constituent. The dilatancy may be enhanced by the inclusion of other components such as particulate fillers.

The energy absorbing composite material of the invention may be employed in a wide variety of applications; for example in protective pads or clothing for humans and animals, in or as energy absorbing zones in vehicles and other objects with which humans or animals may come into violent contact, and in or as packing for delicate objects or machinery. Specific examples of application are in headwear and helmets; protective clothing or padding for elbows, knees, hips and shins; general body protection, for example for use in environments where flying falling objects are a hazard; vehicle dashboards, upholstery and seating. Other potential uses are in garments or padding to protect parts of the body used to strike an object e.g. in a sport or pastime; for example in footwear, such as running shoe soles, football boots, boxing gloves and gloves used in the playing of fives.

The dilatant materials were selected for blending trials in different ratios. The three dilatant materials were the Dow Corning silicone dilatant 3179, Polastosil AMB-12, and pure PBDMS.

The Byrd Published Patent Application discloses a vicoelastic mounting device, presumably mounting for cameras. The viscoelastic material preferably includes an R.T.V.-type silicon-based compound, a dimethyl siloxane compound, [or] a borosilicone rubber combination with silicone oil. The viscoelastic material 60 preferably includes an R.T.V.-type silicon-based compound, a dimethyl siloxane compound, a borosilicone rubber combination with silicone oil, a silicone polymer combination with boric oxide, or a combination thereof, for example. 65.0% Dimethyl Siloxane, hydroxy-terminated polymers with boric acid. Claim 1 of the patent reads: an apparatus for selectively holding a device to a surface, the apparatus comprising: an internal frame having an attachment means at one end for electively attaching the device to the apparatus; and a viscoelastic material fixed about the internal frame and extending beyond a second end of a frame, the viscoelastic material temporarily adhered to the frame and capable of selectively adhering the apparatus to the surface.

The Budden WIPO Patent discloses a flexible sheet material useful as an energy absorbing material is impregnated with a dilatant silicone composition comprising the reaction product of a polydiorgansiloxane and boron compound selected from boric oxide, boric acid, a boric acid precursor, a borate or a partially hydrolysed borate. The silicone composition can be modified by reaction with a hydrophobic compound reactive with silanol groups to improve the resistance to washing. The flexible sheet can be a material, e.g. a fabric, having a negative Poisson's ratio. The impregnated flexible sheet material according to the invention can be used in any of the constructions of energy absorbing material based on fabric or other flexible sheet material described in WO-A-03/022085. Impregnated fabrics according to the invention are particularly suitable for energy absorbing garments for potentially dangerous sports such as motorcycling, skiing, skating, skateboarding, or snowboarding. 60 parts of a dilatant composition formed from a silanol-terminated PDMS and boric acid were dissolved in 40 parts isopropanol to form a dilatant impregnating solution. Various amount of n-octyl branched silicone resin, as set out in Table 4, were dissolved in the solution by mixing with a propeller mixer and 0.05% TIPT was added to each composition. Claim 1 reads as follows: a flexible sheet material impregnated with a dilatant silicone composition comprising the reaction product of a polydiorgansiloxane and a boron compound selected from boric oxide, boric acid, a boric acid precursor, a borate or a partially hydrolysed borate, characterized in that the silicone composition is modified by reaction with a hydrophobic compound reactive with silanol groups.

The Walker Patent discloses a weighted athletic glove. The concept is to have weighted members positioned throughout the glove on the fingers and also on the back of the glove. All of the claims of invention deal with having a weighted feature to the attachments to the glove.

The Fabry Patent discloses a protective glove. In this case the protection deals with an array of shock absorbing hollow sealed cells disposed on various areas of the glove including the back of the glove and the fingers. The protective cells basically have fluid inside them to cushion the blow.

The Douglas Patent is for a hand protector and has various protective elements located on different portions of the glove including the back of the glove. Claim 1 has the protection being a cushioning pad which is releasably connected to the underside of the glove. Claim 2 has the same limitation. Claim 3 has the cushioning pad releasably attached to the back of the glove. Claims 9 and 10 have a hook and loop fastening mechanism by which the cushioning pad is attached.

The Byron Patent discloses a golf glove which basically has various weight segments positioned on different portions of the glove including the back of the glove and along the wrist to protect the pinkie area.

The Goldfine Patent basically deals with an impact absorbing composite.

The '960 Gold Patent discloses a device which has various protective elements along the fingers, the back of the hand and between the fingers but it discloses pocket elements that retain various cushioning material within the pocket.

The Newman Patent has now expired and is a patent for a golf glove. As set forth in Column 2 beginning on Line 35, the patent states:

> "Still another and more specific object of the invention is to provide a golf glove which is so designed as to provide maximum protection to the little finger and ring finger, which are the primary gripping fingers while allowing the thumb, index and middle fingers to be free so that the proper sense of touch may remain, not only with respect to the shaft but also with respect to the other hand."

The Morris Patent has now expired and is for a sports glove.

The Capatosto Patent discloses a hockey glove but it discloses padding 40 on the back side of the inner glove.

The Micheloni Patent discloses a glove for protecting the ligaments, articulations and bones of the hand. The patent discloses:

"A glove for protecting the ligaments, articulations and bones of the hand, has a glove body, to which is associated a plate for protecting the hand palm, at the proximal region of the forearm, which is provided, at one end, with an annular element encompassing the attachment region of the thumb. To the plate there is articulated a shield which is engaged with the forearm, tie-straps being moreover provided connecting the fingers of the glove with the plate."

The Spitzer Patent discloses a sports glove and in particular a goalie glove.

The '137 Gold Patent basically shows a glove where the tips of the fingers are protected by extra padding as best illustrated in FIG. 1. There is also a side panel 103 which protects portions of the pinkie finger. Specifically, the patent states:

"The various panels of the glove 100 are sewn together utilizing seams at various points to connect the panels. Again with reference to FIG. 4, side panel 103 is pre-curved panel. Top panel 101 is secured to side panel 103 with a side seam 172 which extends around top panel 101, also securing top panel 101 to the fourchette (not shown) forming the inner surface of pinkie finger portion 104. Likewise, seam 174 connects lower panel 102 to side panel 103 and the corresponding fourchette (not shown) on the other side of finger 103. Finally, there is a seam (not shown) at the tip of the finger between top panel 101 and bottom panel 102 connecting side panel 103 and the adjacent fourchette (not shown). In some embodiments there is no seam at the tip of the finger. Rather, the seam between fourchettes is at the crotch between fingers."

The Baylor Patent discloses a hand protecting device which includes several examples where there is a padding on the back of the glove 102 and also along the side of the pinkie finger, 25 and 26.

The Oomura Patent discloses a glove for baseball where there is padding but the padding is within the glove as best illustrated in the cross-sectional view of FIG. 4.

The '601 Kleinert Patent discloses a batting glove with padding along the fingers and on all other portions of the glove. This patent has only one independent claim which reads as follows:

"A glove to unload bony prominences of the hand comprising: a covering for said hand with separate elongated sections to receive a plurality of fingers therein, said covering having a top portion for covering a back side of the hand including a top side of said elongated sections to receive a plurality of fingers and a lower portion to cover a palm side of a hand including a bottom side of said elongated sections to receive said plurality of fingers; and, at least one protective pad attached to a bottom portion of the covering for location below the center axis of rotation of a proximal interphalangeal joint and above the center axis of rotation of the metacarphalphalangeal joint of an index finger, said covering at said proximal interphalangeal joint and said metacarphalphalangeal joint of said index finger being absent of padding."

The Mazzarolo Patent discloses a motorcycle glove where the invention is to connect two or more fingers with straps so that they are better able to withstand a blow should there be an accident with the motorcycle.

The Lucas Patent discloses a soccer goal keeper glove which includes as shown in FIG. 8, side folds of mesh material to protect certain fingers.

The '256 Kleinert Patent is for a work glove with a protective material. This is a continuation-in-part of the previously discussed '601 Kleinert Patent. There is only one independent claim in this invention and here the protective padding is to protect the thumb and the palm.

The Howland Patent is for a protective glove and the basic concept of this glove is that it is puncture resistant.

The Mattesky Published Patent Application is for a glove which includes thermo plastic rubber to protect against shock. The patent application involves various protective elements throughout the glove including a fabric secured to at least the back portion of the glove.

The Kogawa Published Patent Application discloses protective members on all parts of the glove including the fingers, on the front of the glove and on the back of the glove.

The Kleinert Published Patent Application is an extension of the previously discussed Kleinert patents.

The WIPO Patent discloses a protection device for fighting games.

The Japanese Patent is in Japanese and clearly is a different type of protective device as best illustrated from the figures.

While the general concept of incorporating shock absorbing and protective material into clothing and athletic gloves is known, the prior art has not addressed the problem of providing protection to the most vulnerable part of a baseball player's hand and wrist when the player is at bat. There is a significant need for a protective glove which addresses this situation.

SUMMARY OF THE INVENTION

When a baseball player is gripping the end of a baseball bat while standing at the plate during his turn at bat, a pitcher is throwing a baseball in the direction of the batter with the intent to have the baseball travel over a portion of home plate so that the pitch will be a strike. The baseball is thrown with substantial velocity and movement so that the batter will miss the baseball when swinging at it with the bat. In an attempt to fool the batter or sometimes to intimidate the batter, the pitcher will throw the baseball at a location where it comes close to where the batter is standing. The image of a baseball traveling at a high rate of speed and also moving in a non-straight line can be intimidating. The batter will try to jump back of out of the way if there is sufficient time to react to the pitch. If the pitch is too fast or the batter does not react quickly enough to jump out of the way, the natural reaction is to raise the baseball bat with both hands so that the batter's hand which is closest to the direction from which the baseball is thrown in front of the batter's hand and face to protect the batter's head and face. If the batter is swinging the bat, during the swinging motion, the portion of the batter's hand and wrist which is closest to the pitcher after completion of a swing is also exposed to the fast moving baseball. As a result, the portion of the batter's hand and wrist which is most exposed during these situation can be hit with the baseball.

To help protect the batter's hands, the batter typically wears at least one batting glove and usually a pair of batting gloves. In the prior art, padding has been placed in the batting glove at a location of the fingers when the glove is worn, at a location on the back of the hand when the glove is worn and at a location on the palm when the glove is worn.

Referring to FIG. 1, there is illustrated a skeleton of a left hand and wrist 20 which includes fingers, the hand and the wrist. The skeleton is viewed from the palm of the hand. The hand and wrist 20 consists of twenty-seven (27) bones as illustrated. The carpel bones of the wrist include the scaphoid 1, the lunate 2, the triquetrum 3, the pisiform 4, the trapezium 5, the trapezoid 6, the capitate 7 and the hamate 8. The hand has metacarpal bones respectively associated with a given finger. The bones of fingers have three sections for the thumb and four sections for the other four fingers. The thumb has a metacarpal bone 9 of the hand aligned with it and a proximal phalange 14 and a distal phalange 16. The index finger has a metacarpal bone 10 of the hand aligned with it and three phalanges—proximal 14, middle 15 and distal 16. The middle finger has a metacarpal bone 11 and three phalanges—proximal 14, middle 15 and distal 16. The fourth finger has a metacarpal bone 12 of the hand aligned with it and three phalanges—proximal 14, middle 15 and distal 16. The pinkie finger has a metacarpal bone 13 of the hand aligned with it and three phalanges—proximal 14, middle 15 and distal 16. It is frequently the bones of the wrist and in particular the hamate 8, the pisiform 4 and the lunate 2 as well as the metacarpal bone 13 in the hand which are aligned with the pinkie finger and which most frequency can sustain damage when a baseball hits the batter's hand as the batter is attempting to protect himself or when a batter's hand is vulnerable after a swing of the bat. In addition, the metacarpal bone 12 aligned with the fourth finger and metacarpal bone 11 aligned with the middle finger can sustain damage when a baseball hits the batter's hand as the batter is attempting to protect himself or when a batter's hand is vulnerable after a swing of the bat.

Referring to FIG. 2, there are eight carpal bones in the wrist divided equally in two rows. The row closer to the arm consists of four bones: scaphoid 1, lunate 2, pisiform 4 and triquetrum 3. The row closer to the hand consist of four bones called trapezium 5, trapezoid 6, capitate 7 and hamate 8. These bones provide a connection between the two bones of the forearm, ulna 17 and radius 18, and the bones making up the hand. There are three different joints in the wrist all contributing to the movement here: the radiocarpel (wrist) joint between the lower end of the radius and the carpel bones on the thumb side of the wrist; the midcarpal joint between the two rows of carpel bones; and the carpometacarpal joint between the carpal ones closer to the hand and the metacarpal bones of the hand. These bones and joints are collectively referred to as "wrist bones". It is also frequently the wrist bones that can sustain damage when a baseball hits the batter's hand and wrist as the batter is attempting to protect himself or when a batter's hand and wrist are vulnerable after a swing of the bat.

The present invention is a novel protective batting glove which is used specifically for protecting the most vulnerable parts of a batter's hands and wrists when the batter is standing at home plate and is gripping the end of a baseball bat and awaiting the arrival of a baseball which is thrown by the pitcher. The invention comprises a unique protective system of a design of a matched pair of batting gloves with one matched pair designed for a right handed batter and one matched pair designed for a left handed batter. For each matched pair of batting gloves, impact and shock absorbing material is incorporated onto selected portions of the exterior of the glove where the grip on the bat causes the hand to be most exposed to a pitch thrown at the batter. The specific one of the matched set of gloves for a right handed or left handed batter has impact and shock absorbing material incorporated onto the exterior of the glove which covers the area where the pinkie finger and its metacarpal bone 13 on the hand are located, and pinkie finger bones proximal bone 14, middle bone 15 and distal bone 16 are located and also covers the area of the hand where the metacarpal bones 11 and 12 are located. In addition, another unique feature of the present invention is that impact and shock absorbing material extends so that they extend over the exposed area of the wrist which is aligned with the pinkie finger and includes carpal bones which are the hamate 8, triquetrum 3, pisiform 4, and lunate 2 and further extends over a portion of the ulna bone 17 which is aligned with the pisiform 4 and lunate 2 bones of the wrist and connect the wrist to the forearm.

It has been discovered, according to the present invention, that if impact and shock absorbing material are incorporated into the top exterior of a baseball glove so that the impact and shock absorbing material covers the area of the hand and wrist including the pinkie finger and bones of the pinkie, metacarpal bones of the hand aligned with the pinkie finger and also with the fourth and middle fingers, and aligned wrist bones and ulna bone which is connected to the forearm, then the most vulnerable portions of the batter's hand and wrist and lower forearm are protected against impact if a thrown baseball hits these areas when a batter is protecting himself from a thrown pitch or most vulnerable after a swing is completed and these areas of the hand, wrist and lower forearm are exposed to the oncoming baseball.

It has been discovered, according to the present invention, that if impact and shock absorbing material are incorporated into the top exterior of a baseball glove so that the impact and shock absorbing material covers at least the area of the hand and wrist including the metacarpal bone 13 of the hand aligned with the pinkie finger and the wrist bones on the exterior most portion of the hand aligned with the pinkie finger which are the hamate 8, triquetrum 3 and pisiform 4, then the most vulnerable portions of the batter's hand and wrist are protected against impact if a thrown baseball hits these areas when a batter is protecting himself from a thrown pitch or most vulnerable during a swing of the bat and these areas of the hand and wrist are exposed to the oncoming baseball.

It has further been discovered, according to the present invention, that the maximum protection and flexibility of gripping the bat is afforded a batter if the gloves worn on the right hand and the left hand are matched so that the impact and shock absorbing material of each glove will be exposed in the direction of a thrown ball when a batter is gripping a baseball bat, if the batter raises the gripped bat to cause the batting gloves to protect the batter's face and head, and during and after the completion of a swing of a bat, and the gloves are designed so that the adjacent area of the second glove does not have shock absorbing material on it so that there is a smooth fit at the adjacent location of the two gloves as the batters grips the baseball bat. In this way, the primary glove which has the impact and energy absorbing material positioned at a location to receive an impact from a baseball is not interfered with by the second non-primary glove which is smooth and does not have any impact and shock absorbing material at the location where the gloves are adjacent to each other when the baseball bat is gripped by the batter, and this combination causes a lack of interference with the batter's normal grip of a baseball bat so that the batter's normal swing is not impaired. The secondary glove also has impact and shock absorbing material on it to cushion that hand of the player when the position of the batter causes that hand to be exposed to a thrown baseball.

It has also been discovered, according to the present invention, that if the impact and energy absorbing material is formed on the outside of the protective glove and is left exposed and uncovered, then the impact and absorbing performance of the material will be substantially increased to thereby more effectively receive the impact from the force of the object such as the baseball and cushion the blow against the wearer of the glove. It is also within the spirit and scope of the present invention to cover the impact and energy absorbing material with fabric, leather or other covering material It has additionally been discovered, according to the present invention, that if the impact absorbing material is comprised of a multiplicity of impact absorbing cells which are separated from each other by a gap, then the gap facilitates flexibility of the glove so that the batter can grip the bat and swing the bat without interference from the batting glove. The shock absorbing material can be in the form of a matrix of cells of shock absorbing material formed in a lattice with an interconnecting layer onto which the shock absorbing cells are attached, which layer is integrally formed with the material of the glove to enhance retention of the shock absorbing material. Further, the interconnecting layer and shock absorbing cells are flexible so that they can flex with the glove as the gloved hand is wrapped around the bat handle and conform to the shape of the curved glove as it is wrapped around the bat handle to thereby provide maximum flexibility for the glove. By forming the flexible shock absorbing material so that it extends to protect the wearer's wrist bones and ulna bone which connects the wrist bones to the lower forearm, the most vulnerable bones, which if broken can cause substantial recovery periods of career ending injury, are most protected.

It is a key object of the present invention to prevent injury to the wrist bones of the batter when a pitch is thrown too close to a batter, and as the batter draws his hands into a defensive position to both get away from the ball and to protect the batter's head, the arrangement of the protective pads on the present invention gloves are such that the referenced bones in the wrist are protected by the padding arrangement, a benefit which prior art gloves do not provide.

It is an object of the present invention to have at least one batting glove which comprises impact and shock absorbing material incorporated into the top exterior of a baseball glove so that the impact and shock absorbing material covers at least the area of the hand aligned with the pinkie finger and the area of the wrist aligned with the pinkie finger and in addition may also cover the area of the pinkie finger and bones of the pinkie, metacarpal bones of the hand aligned with the pinkie finger and also with the fourth and middle fingers, and aligned wrist bones and ulna bone which is connected to the forearm, so that the most vulnerable portions of the batter's hand and wrist and lower forearm are protected against impact if a thrown baseball hits these areas when a batter is protecting himself from a thrown pitch or most vulnerable after a swing is completed or partially completed and these areas of the hand, wrist and lower forearm are exposed to the oncoming baseball.

Preferably, the glove which comprises the impact absorbing material is the glove which is higher on the baseball bat as the two hands grip the baseball bat so that the exposed impact and shock absorbing material is at a location where it affords maximum protection.

It is another object of the present invention to provide matching protective gloves so that maximum flexibility and lack of interference with a batter gripping the baseball bat is afforded a batter if the gloves worn on the right hand and the left hand are matched so that the impact and shock absorbing material of each glove will be exposed in the direction of a thrown ball when a batter is gripping a baseball bat and during and after the completion of a swing of a bat, and the gloves are designed so that the adjacent area of the second glove does not have shock absorbing material on it so that there is a smooth fit at the adjacent location of the two gloves as the batter grips the baseball bat. In this way, the primary glove which has the impact and energy absorbing material positioned at a location to receive an impact from a baseball is not interfered with by the second non-primary glove which is smooth and does not have any impact and shock absorbing material at the location where the gloves are adjacent to each other when the baseball bat is gripped by the batter.

It is a further object of the present invention to have matching gloves for a right handed batter and separately designed matching gloves for a left handed batter.

It is also an object of the present invention to create impact and energy absorbing material formed on the outside of the protective glove and to cause the impact and energy absorbing material to be exposed and not covered to thereby increase the impact and absorbing performance of the material so that it will more effectively receive the impact from the force of the object such as the baseball and cushion the blow against the wearer of the glove. It is also within the spirit and scope of the present invention to cover the impact and energy absorbing material with fabric, leather or other covering material It is an additional object of the present invention for the impact absorbing material to be comprised of a multiplicity of impact absorbing cells which are separated from each other by a gap, to thereby increase flexibility of the glove and enhance the batter's ability to grip the baseball bat when wearing the protective gloves. The shock absorbing material can be in the form of a matrix of cells of shock absorbing material formed in a lattice with an interconnecting layer onto which the shock absorbing cells are attached, which layer is integrally formed with the material of the glove to enhance retention of the shock absorbing material. Further, the interconnecting layer and shock absorbing cells are flexible so that they can flex with the glove as the gloved hand is wrapped around the bat handle and conform to the shape of the curved glove as it is wrapped around the bat handle to thereby provide maximum flexibility. By forming the flexible shock absorbing material so that it protects the wearer's wrist bones and ulna bone which connects the wrist bones to the lower forearm, the most vulnerable bones are protected.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
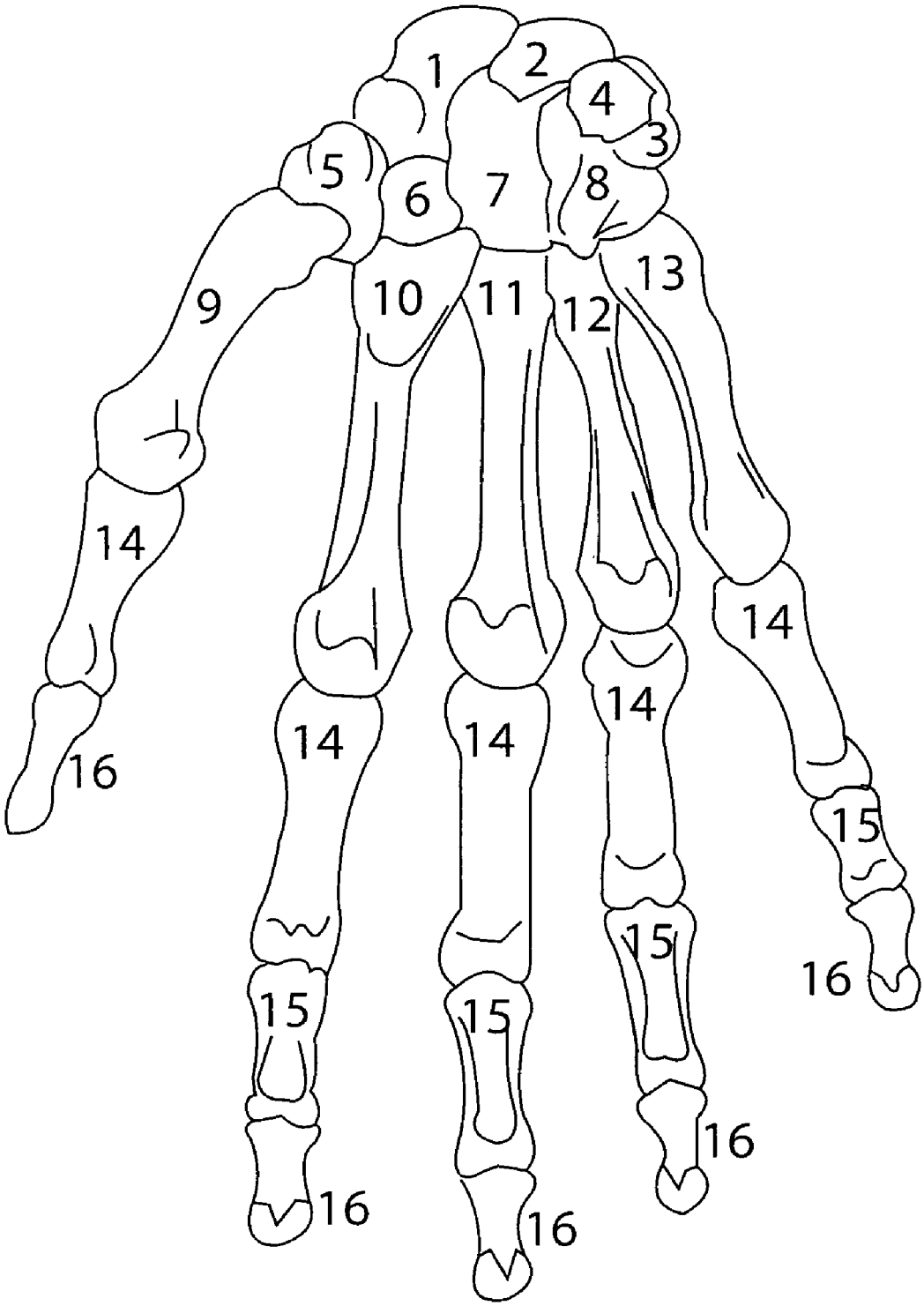
FIG. 1 is a drawing of the skeleton bones of a hand including the metacarpal bones of a hand and phalanges bones of the fingers, as well as the carpel bones in the wrist.
Figure 2A:
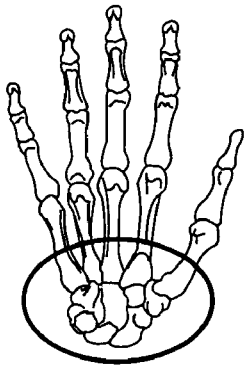
FIG. 2A is an insert to show the bones illustrated in FIG. 1 and how the wrist bones relate to the finger bones shown in FIG. 1.
Figure 2:
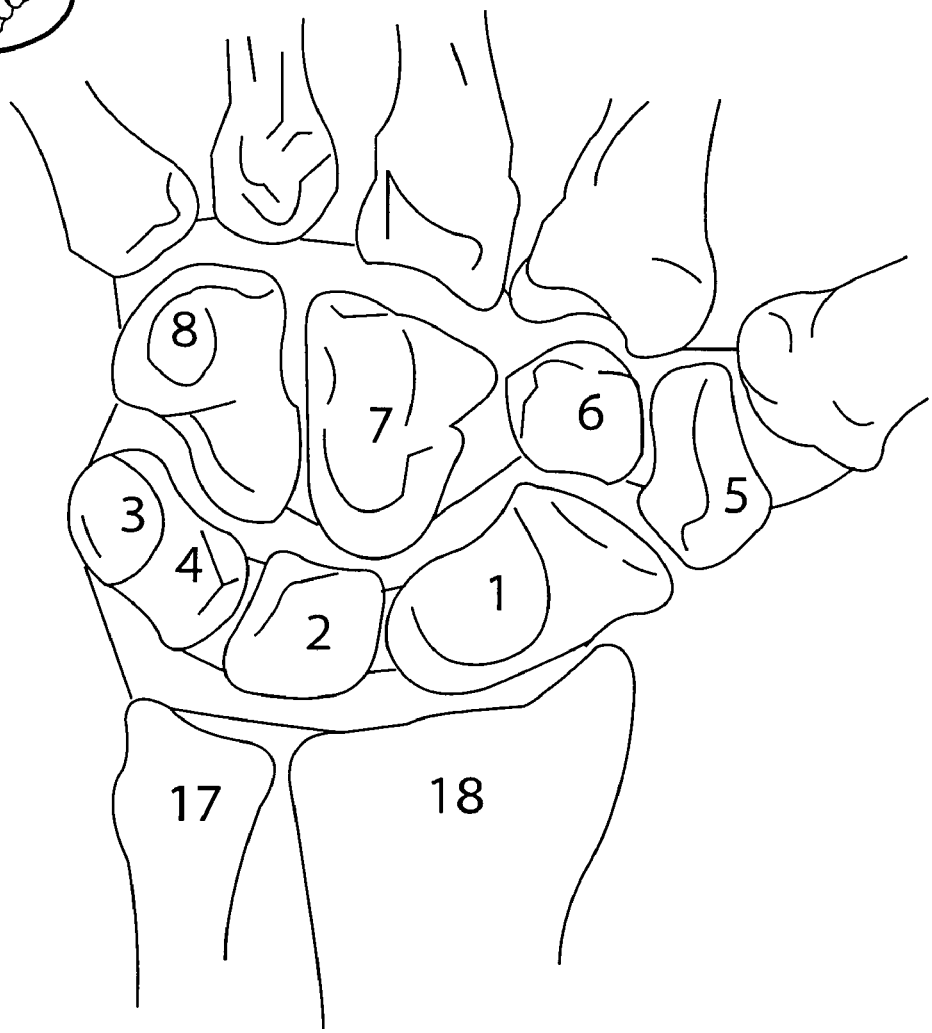
FIG. 2 is a drawing of the carpel bones in a wrist and the ulna bone which connects wrist bones to the lower forearm.
Figure 3:
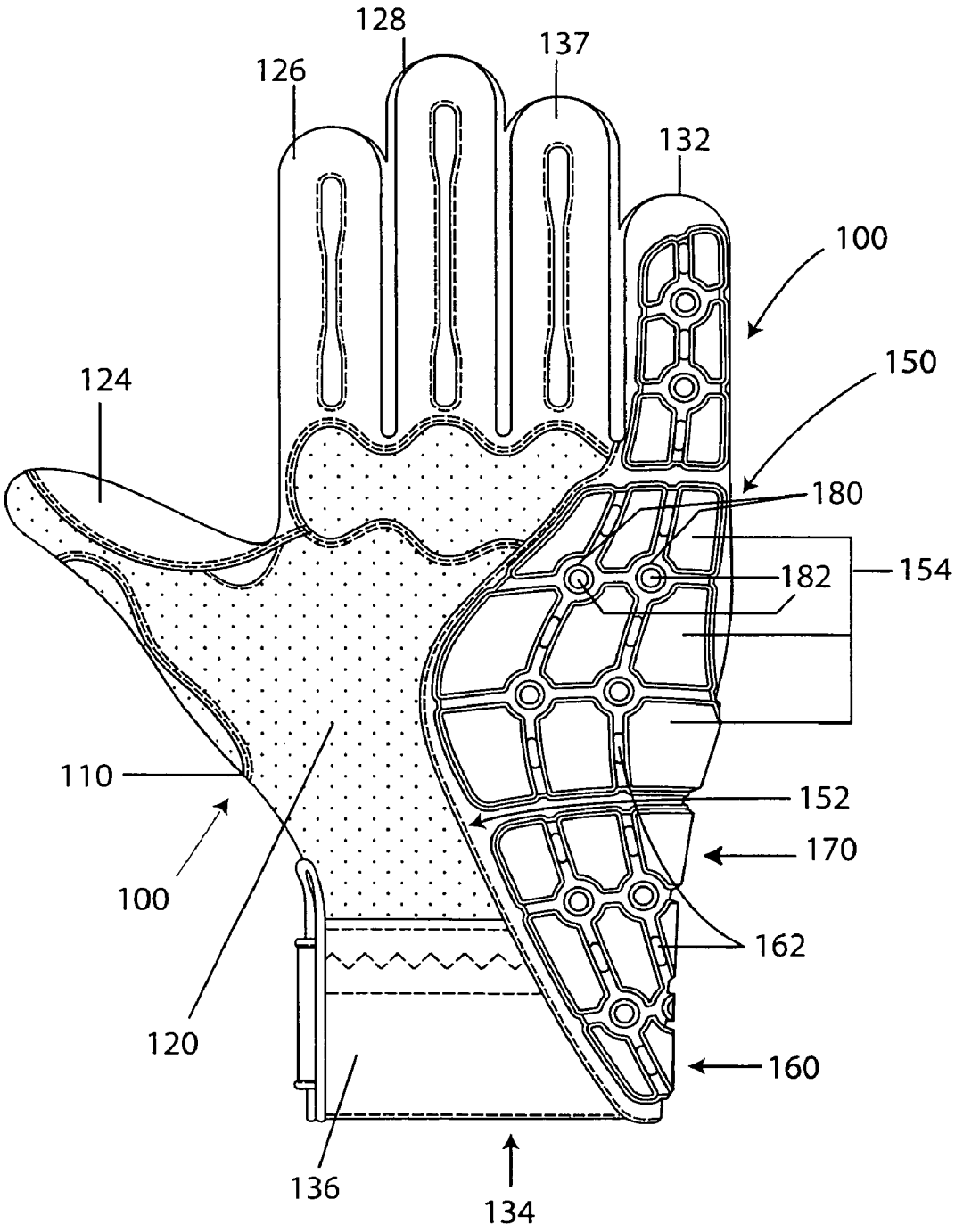
FIG. 3 is a top plan view of a first embodiment of the BASEBALL BATTING GLOVE WITH PROTECTIVE SHOCK ABSORBING MEMBERS ON THE EXTERIOR OF THE GLOVE which is a right handed glove used by a right handed batter.
Figure 4:
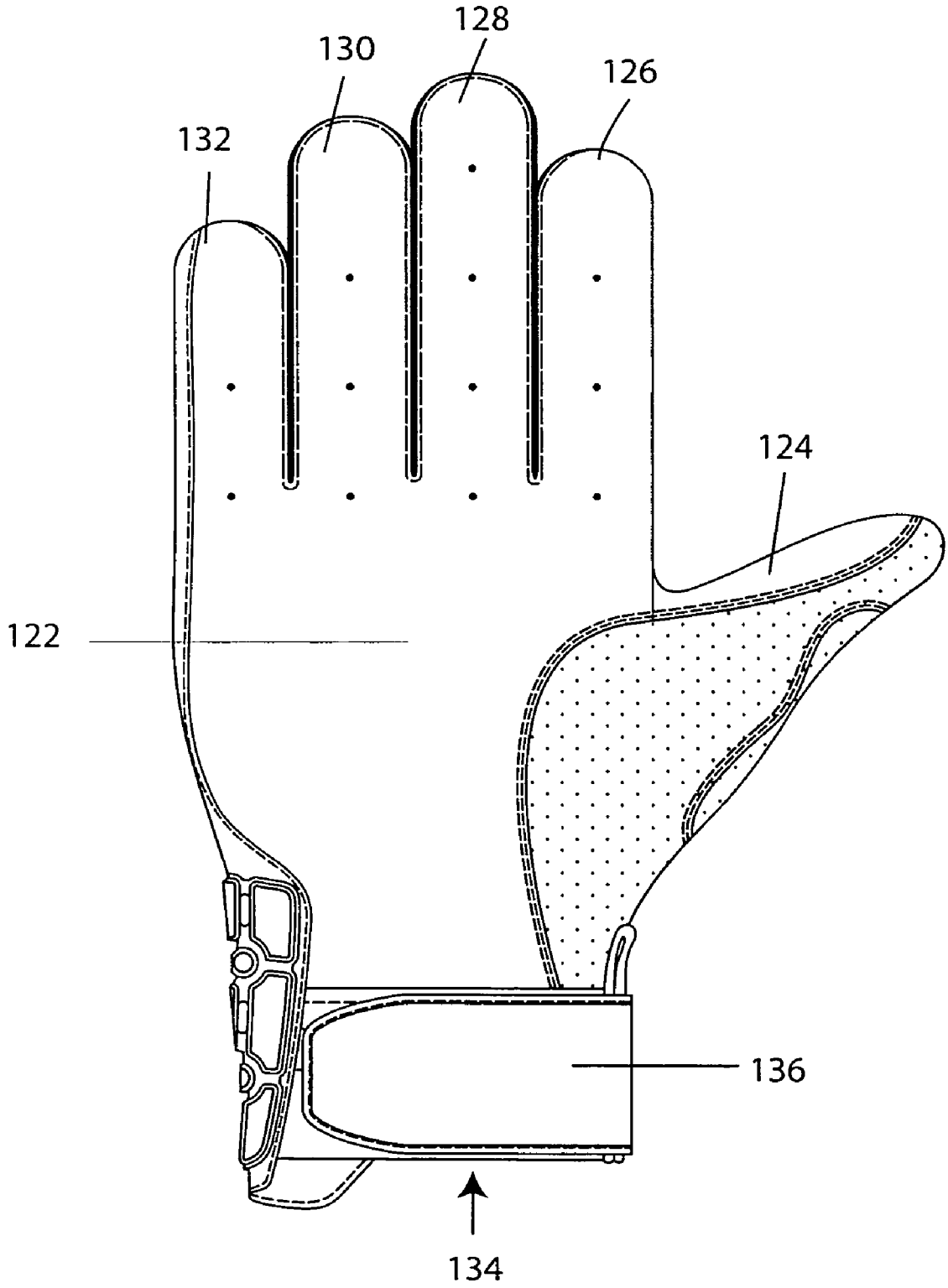
FIG. 4 is a bottom plan of the first embodiment.
Figure 5:
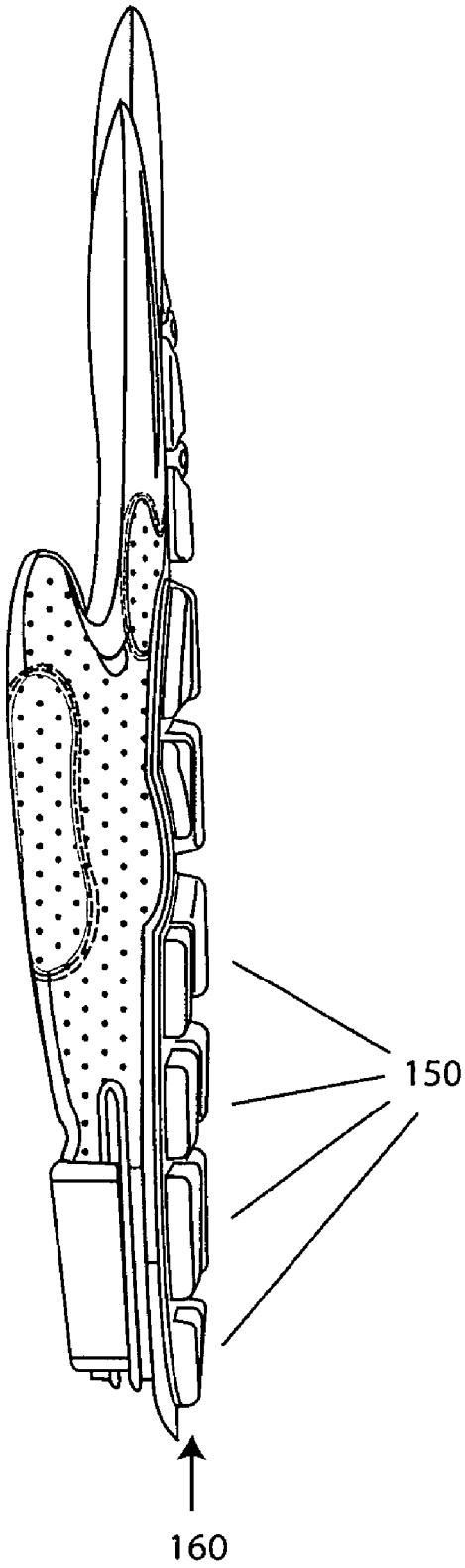
FIG. 5 is a side elevational view when viewed from the left side of the first embodiment.
Figure 6:
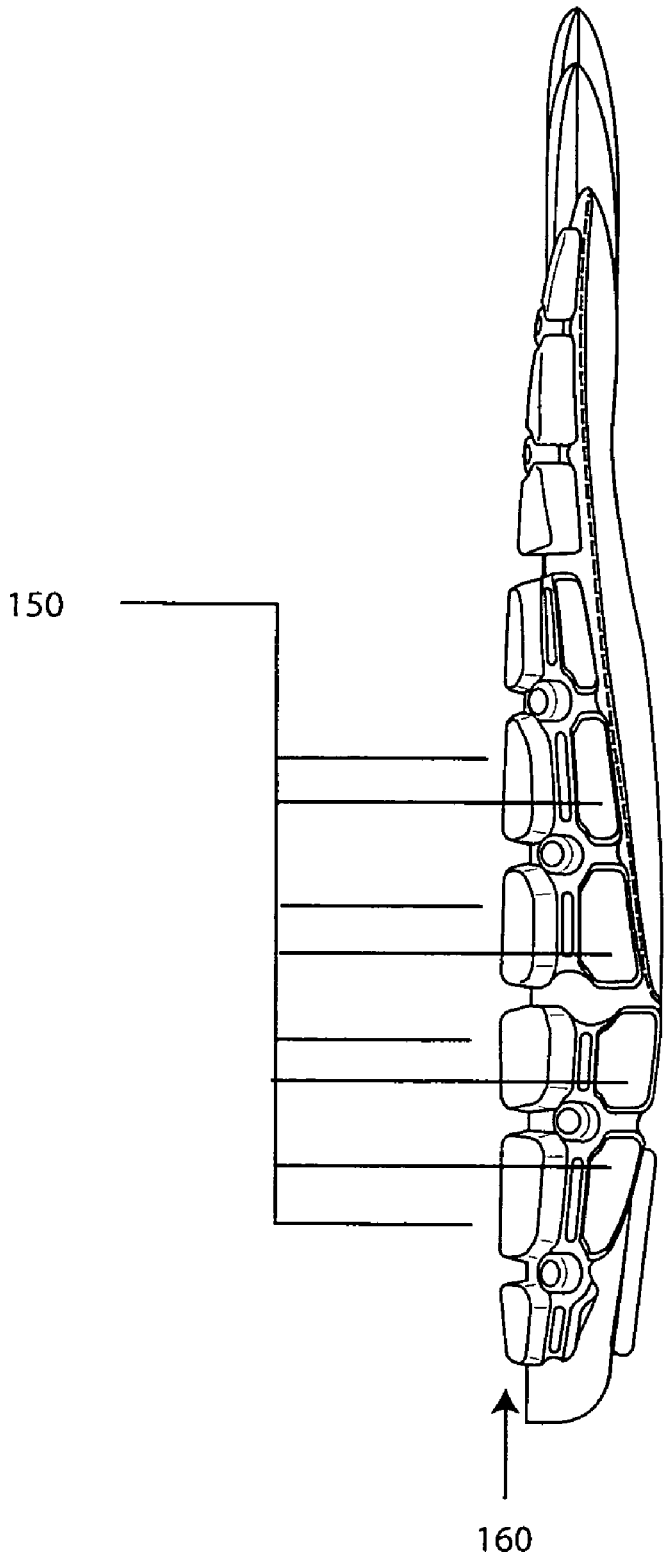
FIG. 6 is a side elevational view when viewed from the right side of the first embodiment.
Figure 7:
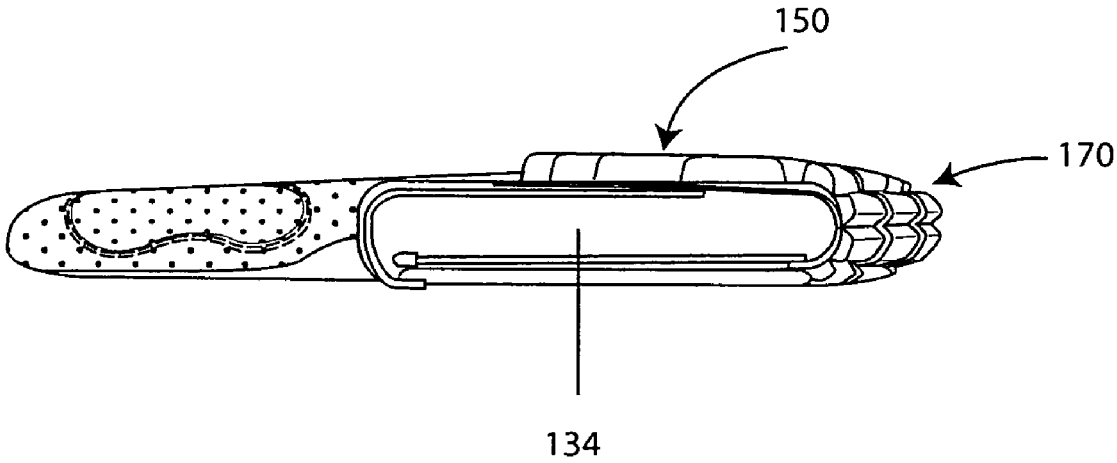
FIG. 7 is a bottom end view of the first embodiment.
Figure 8:
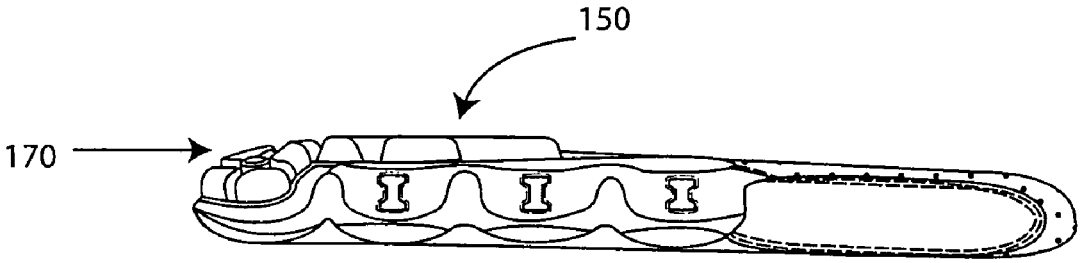
FIG. 8 is a top end view of the first embodiment.
Figure 9:
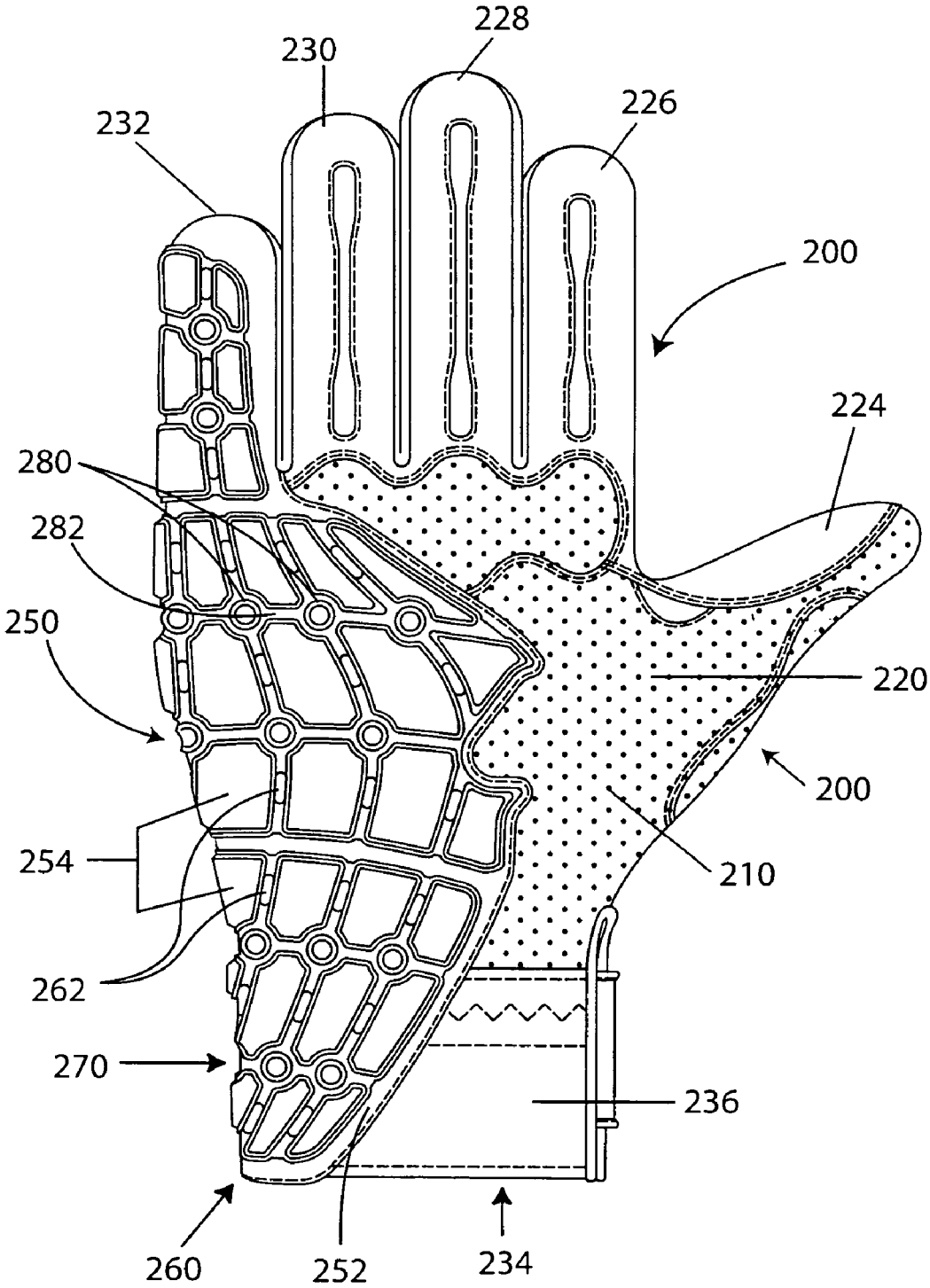
FIG. 9 is a top plan view of a second embodiment of the BASEBALL BATTING GLOVE WITH PROTECTIVE SHOCK ABSORBING MEMBERS ON THE EXTERIOR OF THE GLOVE which is a left handed glove used by a right handed batter.
Figure 10:
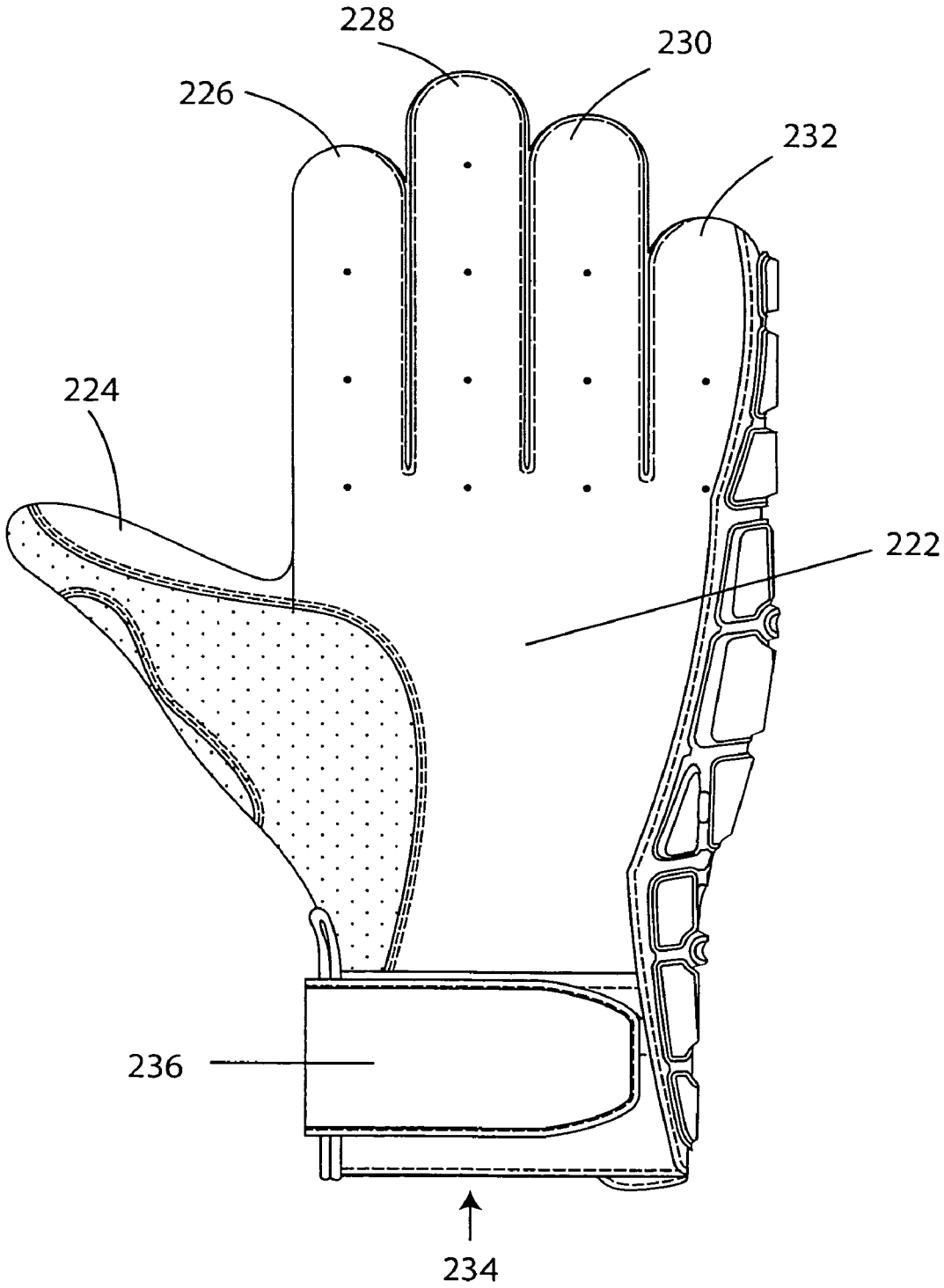
FIG. 10 is a bottom plan view of the second embodiment.
Figure 11:
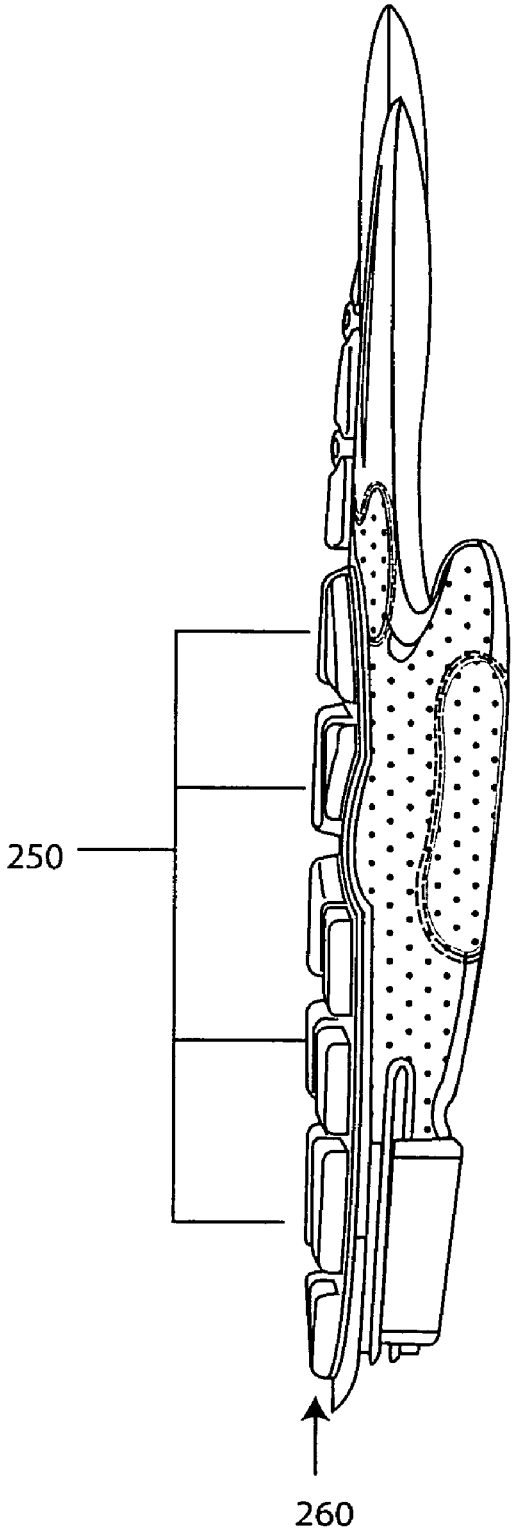
FIG. 11 is a side elevational view when viewed from the right side of the second embodiment.
Figure 12:
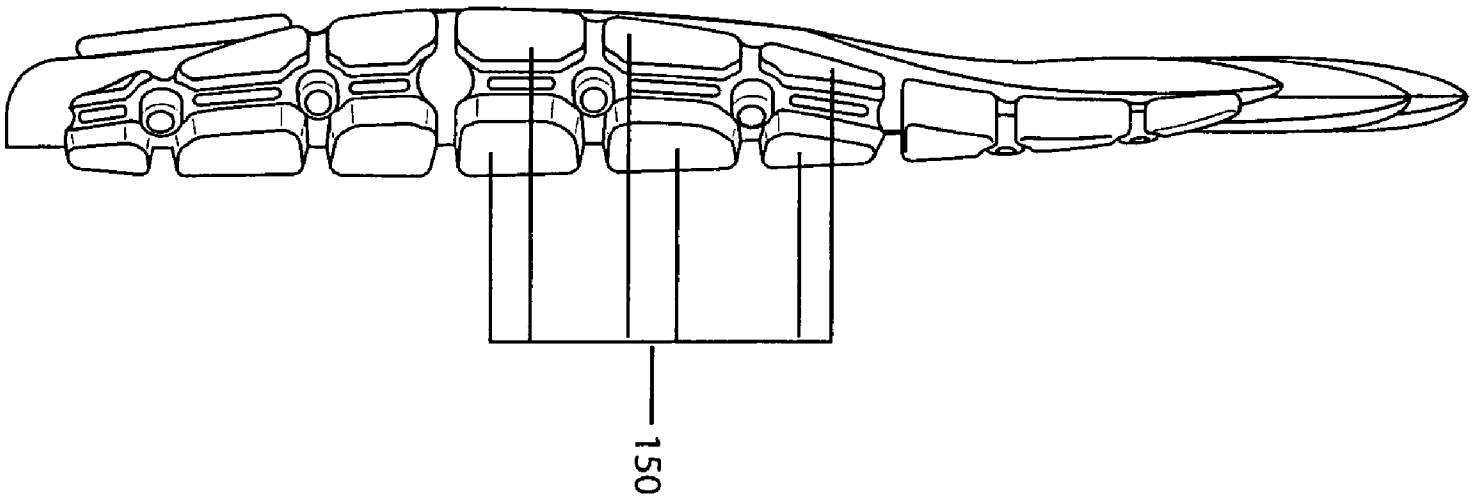
FIG. 12 is a side elevational view when viewed from the left side of the second embodiment.
Figure 13:
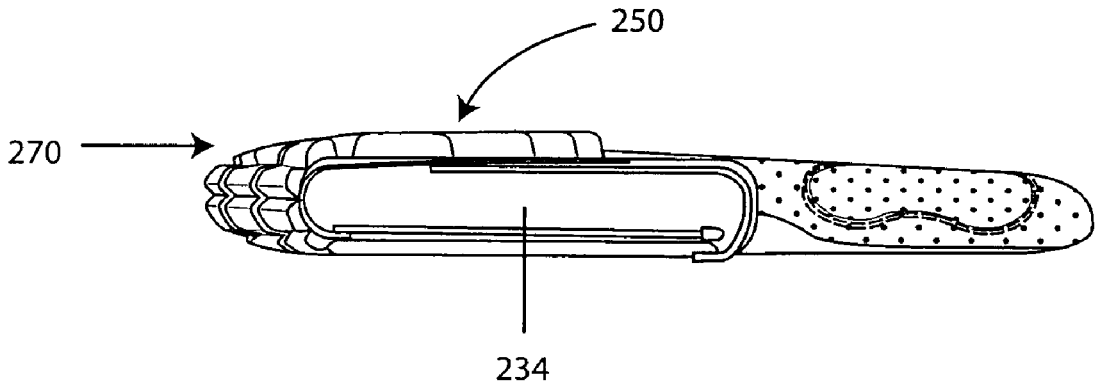
FIG. 13 is a bottom end view of the second embodiment.
Figure 14:
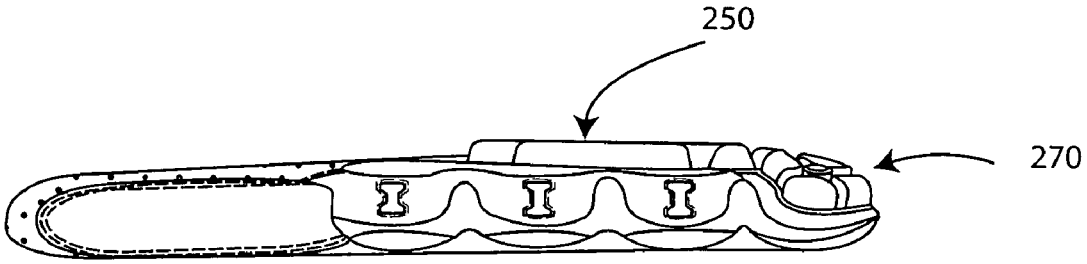
FIG. 14 is a top end view of the second embodiment.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 3 through 14, there is illustrated a pair of protective baseball bating gloves for use by a right handed batter in accordance with the present invention. The glove worn on the right hand is illustrated in FIGS. 3 through 8. The right handed glove 100 for a right hand batter is made of breathable synthetic or leather material such as leather, synthetic leather and stretchable nylon and includes a body 110 having a top or back section 120 which covers the back the hand and a palm section 122. The back section 120 and palm section 122 extend to finger receiving sections including a thumb receiving section 124, a forefinger receiving section 126, a middle finger receiving section 128, a fourth finger receiving section 130 and a pinkie finger receiving section 132. The rear or bottom of the glove 100 has an opening 134 through which the right hand and fingers are inserted so that a thumb and respective fingers are respectively received within the a respective thumb receiving section and finger receiving sections. An adjustment or tightening strap 136 is located adjacent the bottom opening 134 to tighten the glove 100 around the wrist of the wearer. The glove is long enough so that the shock absorbing cells 154 can cover the wrist bones and a portion of the ulna bone.

The improvement of the present invention is the addition of a flexible matrix 150 of impact and shock absorbing cells 154 which are formed on an interconnecting layer 152 and comprise a multiplicity of impact and shock absorbing cells 154 which are formed in spaced apart longitudinal rows 160 and transverse rows 170, each shock absorbing cell attached onto the interconnecting layer 152 and separated from adjacent shock absorbing cells by a gap, the design also including a circular shock absorbing post 180 attached to the interconnecting layer 152 and at a location of a corner of each respective four spaced apart shock absorbing cells having a corner closest to each other. Each shock absorbing post 180 has a central opening 182.

Figure 33:
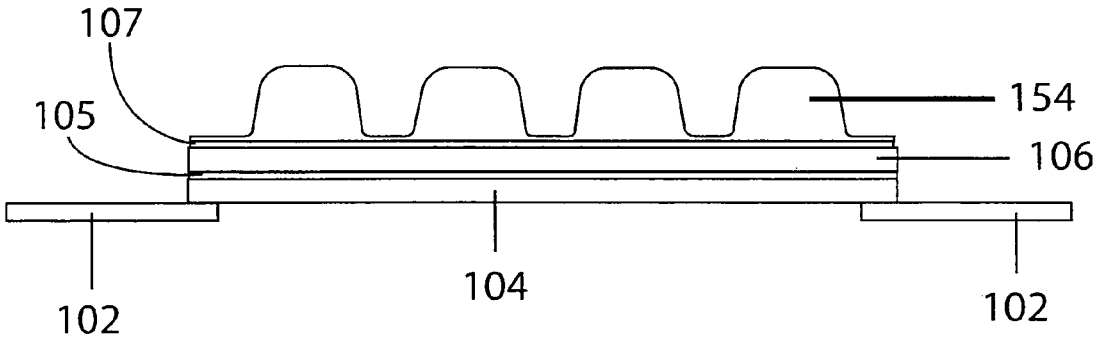
FIG. 33 is a cross-sectional view illustrating the glove layers, a substrate material, a thermoplastic bonding layer and an impact and shock absorbing cell layer.

The preferred embodiment of the glove and shock absorbing material formation is illustrated in the cross-sectional view of FIG. 33. The glove layer 102 has a substrate material 104 sewn into the glove material 102. The glove layer 102 can be made of leather, synthetic leather, stretchable nylon, etc. The substrate material can also be made of leather, synthetic leather, stretchable nylon, etc. A thermoplastic bonding layer 106 is bonded to the substrate layer 104 and the impact absorbing cells 154 are bonded to the thermoplastic layer 106. One method to create the bonding is radio frequency bonding. A conducting agent 105 is placed between the substrate layer 104 and the thermoplastic bonding layer 106 and another conducting agent 107 is placed between the thermoplastic bonding layer 106 and the impact absorbing cell 154 and the entire assembly is bonded together by radio frequency bonding. A multiplicity of gaps 162 are formed between the shock absorbing cells 154 and a multiplicity of shock absorbing posts 180 with central openings 182 are also formed. The gaps 162 and posts 180 enhance the flexibility of the gloves. In preferred embodiments, the impact and shock absorbing cells 154 are made of material selected from the group consisting of a soft polyvinyl chloride foam, soft polyvinyl chloride solid material, silicone foam, silicone solid material, flexible thermoplastic foam, flexible thermoplastic solid material, and flexible thermoplastic rubber. It is also within the spirit and scope of the present invention to change conducting agents 105 and 107 to a non-RF conducting agent and also to be replaced with a simple bonding agent. It is also within the spirit and scope of the present invention to have a single bonding agent 105 or 107 and not both 105 and 107. In addition, it is also within the spirit and scope of the present invention to have the cells 154 connected to the substrate 104 and eliminate the thermoplastic bonding layer 106 and only have one layer of bonding agent, either 105 or 107.

As illustrated in FIGS. 3 through 8, the flexible matrix 150 of shock absorbing cells 154 is on the outside or exterior surface of the glove 100 and extends over the area of the pinkie finger receiving section 132 and cover the entire length of the glove so as to cover the area of the glove which receives the pinkie finger including its three phalanges—proximal 14, middle 15 and distal 16 and the metacarpal bone 13 of the hand aligned with the pinkie finger. Preferably the matrix of shock absorbing cells 150 also covers the metacarpal bone 12 of the hand associated with the fourth finger and the metacarpal bone 11 of the hand associated with the middle finger. The key innovation of the present invention is that the matrix 150 of shock absorbing cells 154 extend over the area of the glove to cover a portion of the wrist bones aligned with the pinkie finger cover the wrist bones and may also cover the ulna bone. The wrist bones which are thereby covered are the carpal bones which are the hamate 8, trequetrum 3, pisiform 4, and lunate 2. The capitate bone 7 can also be covered.

The key innovation of the present invention is that the matrix 150 of shock absorbing cells 154 is on the exterior of the glove 100 and at least covers the bone of the hand aligned with the pinkie finger which is the metacarpal bone 13 and at least covers the bones of the wrist aligned with this metacarpal bone 13 which bones are at least the hamate 8, the triquetrum 3 and the pisiform 4. Preferably the shock absorbing matrix 150 also covers the ulna bone 17 at its location adjacent the wrist. Although there are gaps to provide flexibility, the impact and shock absorbing protection is continuous to cover the metacarpal bone 13 on its top, side and bottom to cover the exposed top of the wrist bones. In this way, the bones which are most vulnerable to being hit by a pitch are covered and protected. Injury to these bones can be career ending or at least cause a player to be sidelined and undergo recovery for many weeks or months.

The glove worn on the left hand for a right handed batter is illustrated in FIGS. 9 through 14. The glove worn on the left hand is illustrated in FIGS. 9 through 14. The left handed glove 200 for a right hand batter is made of breathable synthetic or leather material such as leather, synthetic leather and stretchable nylon and includes a body 210 have a top or back section 220 which covers the back the hand and a palm section 222. The back section 220 and palm section 222 extend to finger receiving sections including a thumb receiving section 224, a forefinger receiving section 226, a middle finger receiving section 228, a fourth finger receiving section 230 and a pinkie finger receiving section 232. The rear or bottom of the glove 200 has an opening 234 through which the left hand and fingers are inserted so that a thumb and respective finger are respectively received within the a respective thumb receiving section and finger receiving sections. An adjustment or tightening strap 236 is located adjacent the bottom opening 234 to tighten the glove 200 around the wrist of the wearer. The glove is long enough to cover the wrist bones and the ulna bone.

The improvement of the present invention is the addition of a flexible matrix 250 of impact and shock absorbing cells 254 which are formed on an interconnecting layer 252 and comprise a multiplicity of impact and shock absorbing cells 254 which are formed in spaced apart longitudinal rows 260 and transverse rows 270, each shock absorbing cell attached onto the interconnecting layer 252 and separated from adjacent shock absorbing cells by a gap, the design also including a circular shock absorbing post 280 attached to the interconnecting layer 252 and at a location of a corner of each respective four spaced apart shock absorbing cells having a corner closest to each other. Each shock absorbing post 280 has a central opening 282.

The preferred embodiment of the glove and shock absorbing material formation is illustrated in the cross-sectional view of FIG. 33 and the formation is the same for the left handed glove as for the right handed glove. The glove layer has a substrate material sewn into the glove material. The glove layer can be made of leather, synthetic leather, stretchable nylon, etc. The substrate material can also be made of leather, synthetic leather, stretchable nylon, etc. A thermoplastic bonding layer is bonded to the substrate layer and the impact absorbing cells are bonded to the thermoplastic layer. One method to create the bonding is radio frequency bonding. A conducting agent is placed between the substrate layer and the thermoplastic bonding layer and another conducting agent is placed between the thermoplastic bonding layer and the impact absorbing cell and the entire assembly is bonded together by radio frequency bonding. As illustrated in FIGS. 9 through 14, a multiplicity of gaps 262 are formed between the shock absorbing cells 254 and a multiplicity of shock absorbing posts 280 with central openings 282 are also formed. The gaps and posts enhance the flexibility of the gloves. In preferred embodiments, the impact and shock absorbing cells 154 are made of material selected from the group consisting of a soft polyvinyl chloride foam, soft polyvinyl chloride solid material, silicone foam, silicone solid material, flexible thermoplastic foam, flexible thermoplastic solid material, and flexible thermoplastic rubber.

As illustrated in FIGS. 9 through 14, the flexible matrix 250 of shock absorbing cells 254 is on the outside or exterior surface of the glove 200 and extends over the area of the pinkie finger receiving section 232 and cover the entire length of the glove so as to cover the area of the glove which receives the pinkie finger including its three phalanges—proximal 14, middle 15 and distal 16 and the metacarpal bone 13 of the hand aligned with the pinkie finger. Preferably the matrix 250 of shock absorbing cells 254 also covers the metacarpal bone 12 of the hand associated with the fourth finger and the metacarpal bone 11 of the hand associated with the middle finger. The key innovation of the present invention is that the matrix 250 of shock absorbing cells 254 extend over the area of the glove to cover a portion of the wrist bones aligned with the pinkie finger cover the wrist bones and may also cover the ulna bone. The wrist bones which are thereby covered are the carpal bones which are the hamate 8, trequetrum 3, pisiform 4, and lunate 2. The capitate bone 7 can also be covered.

The key innovation of the present invention is that the matrix 250 of shock absorbing cells 254 is on the exterior of the glove 200 and at least covers the bone of the hand aligned with the pinkie finger which is the metacarpal bone 13 and at least covers the bones of the wrist aligned with this metacarpal bone 13 which bones are at least the hamate 8, the triquetrum 3 and the pisiform 4. Preferably the shock absorbing matrix 250 also covers the ulna bone 17 at its location adjacent the wrist. Although there are gaps to provide flexibility, the impact and shock absorbing protection is continuous to cover the metacarpal bone 13 on its top, side and bottom and to cover the exposed top of the wrist bones. In this way, the bones which are most vulnerable to being hit by a pitch are covered and protected. Injury to these bones cane be career ending or at least cause a player to be sidelined and undergo recovery for many weeks or months.

Figure 15:
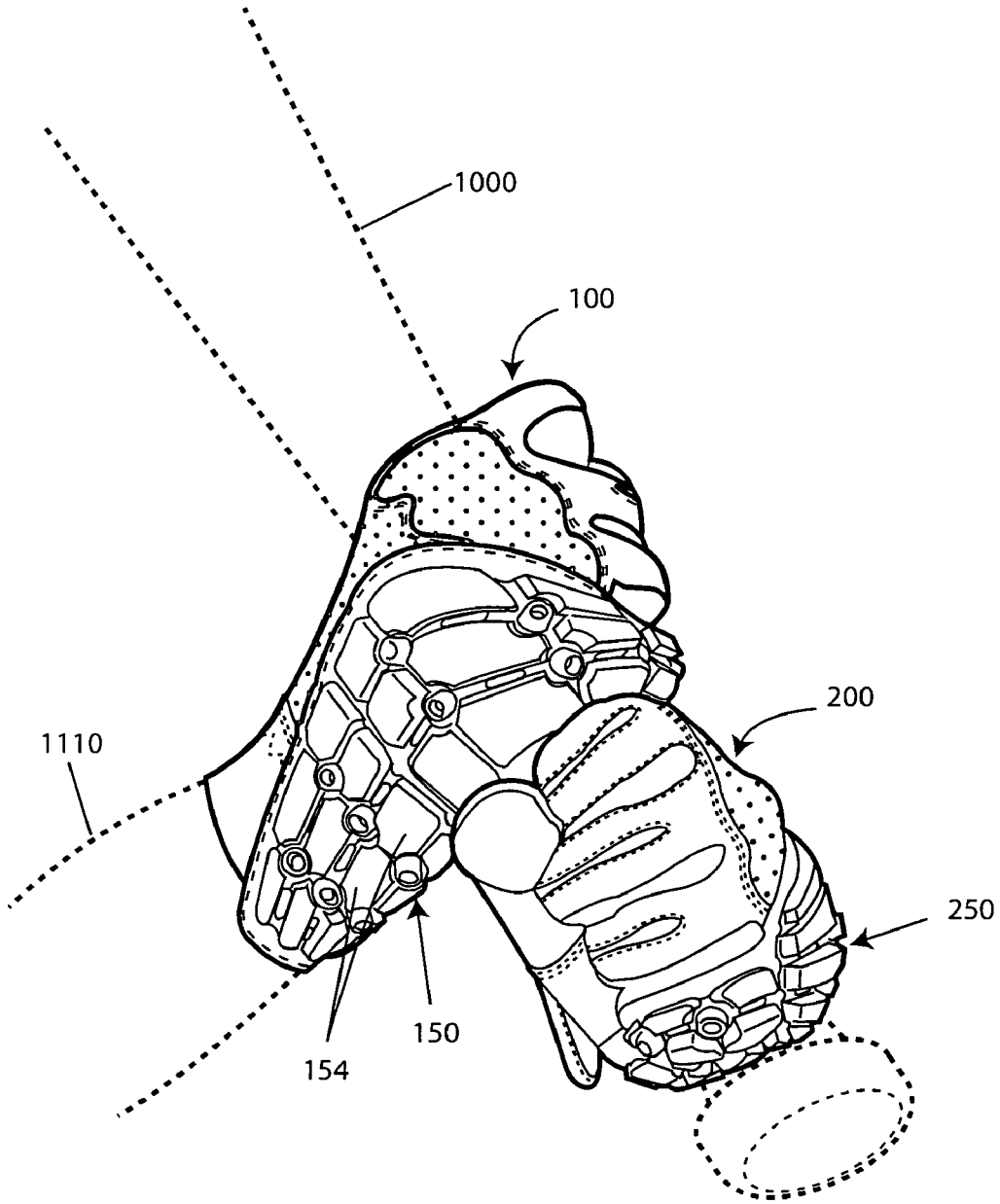
FIG. 15 is a perspective view of the first and second embodiments of the present invention as worn by a right handed batter when gripping the bottom end of a baseball bat while standing at home plate to await a pitch, the baseball bat is shown in dotted lines and is not a part of this invention and a portion of a batter's arm is also shown in dotted lines and is not a part of this invention.
Figure 16:
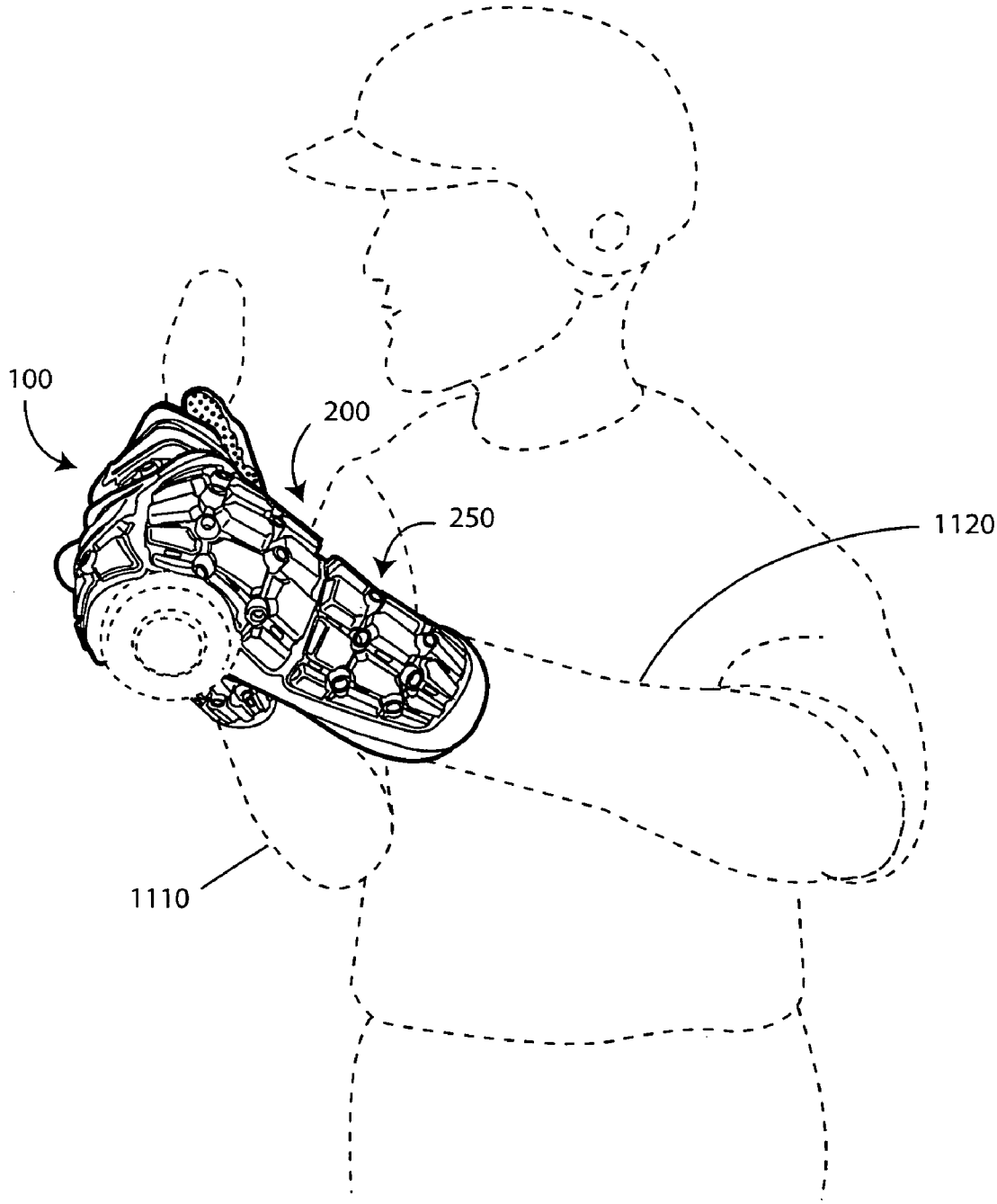
FIG. 16 is a perspective view of the first and second embodiments of the present invention as worn by a right handed batter when gripping the bottom end of a baseball bat with the bat raised by the batter to protect his face and head from a baseball coming in a direction which will hit the batter, with both gloves having impact and shock absorbing material to protect the batter in various orientations depending on how the batter moves. The baseball bat is shown in dotted lines and is not a part of this invention and the batter is also shown in dotted lines and is not a part of this invention.
Figure 17:
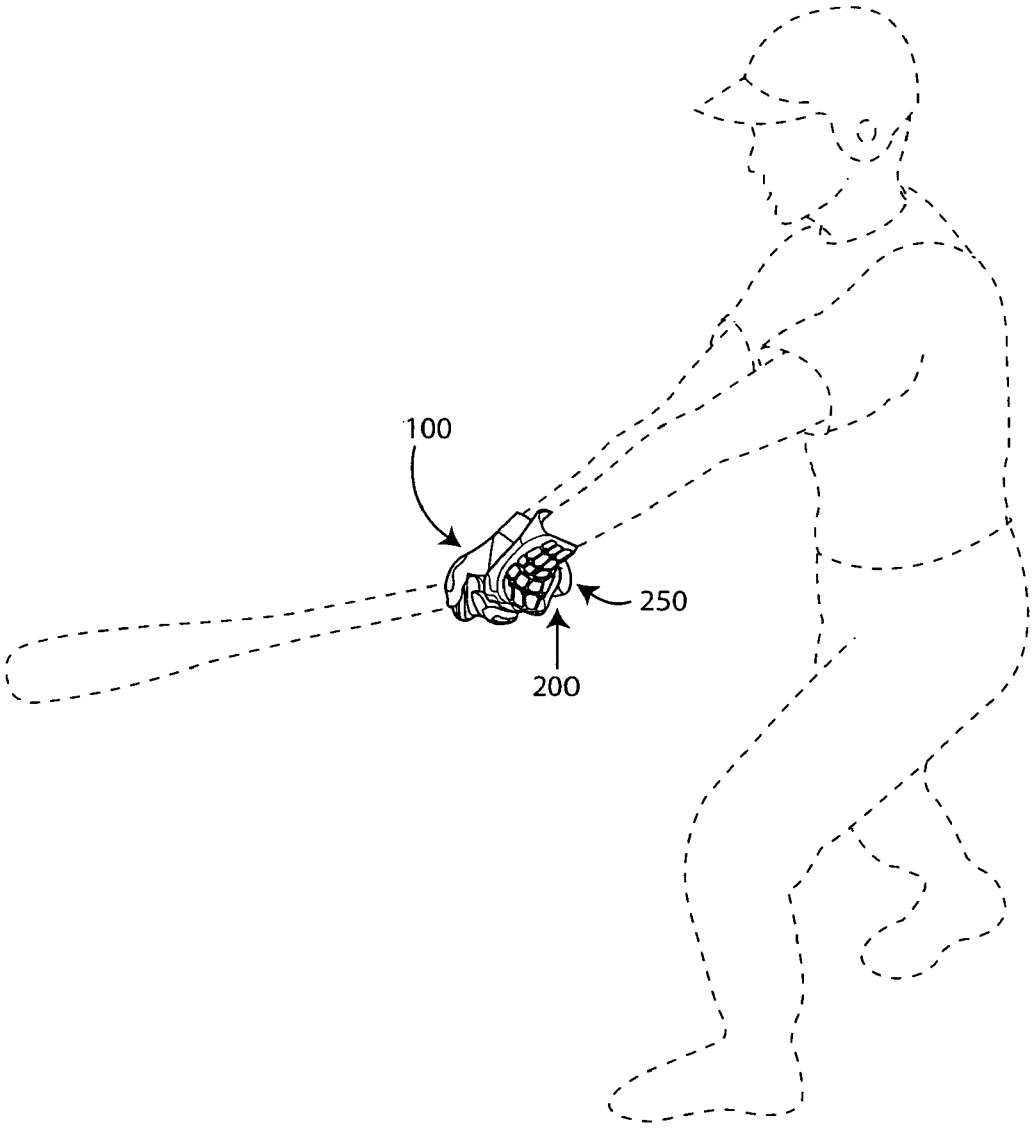
FIG. 17 is a perspective view of the first and second embodiments of the present invention as worn by a right handed batter when gripping the bottom end of a baseball bat being swung in the middle of a swing with a baseball coming in the direction of the batter's hands during the swing, with both gloves having impact and shock absorbing material to protect the batter in various swinging positions. The baseball bat is shown in dotted lines and is not a part of this invention and the batter is also shown in dotted lines and is not a part of this invention.
Figure 18:
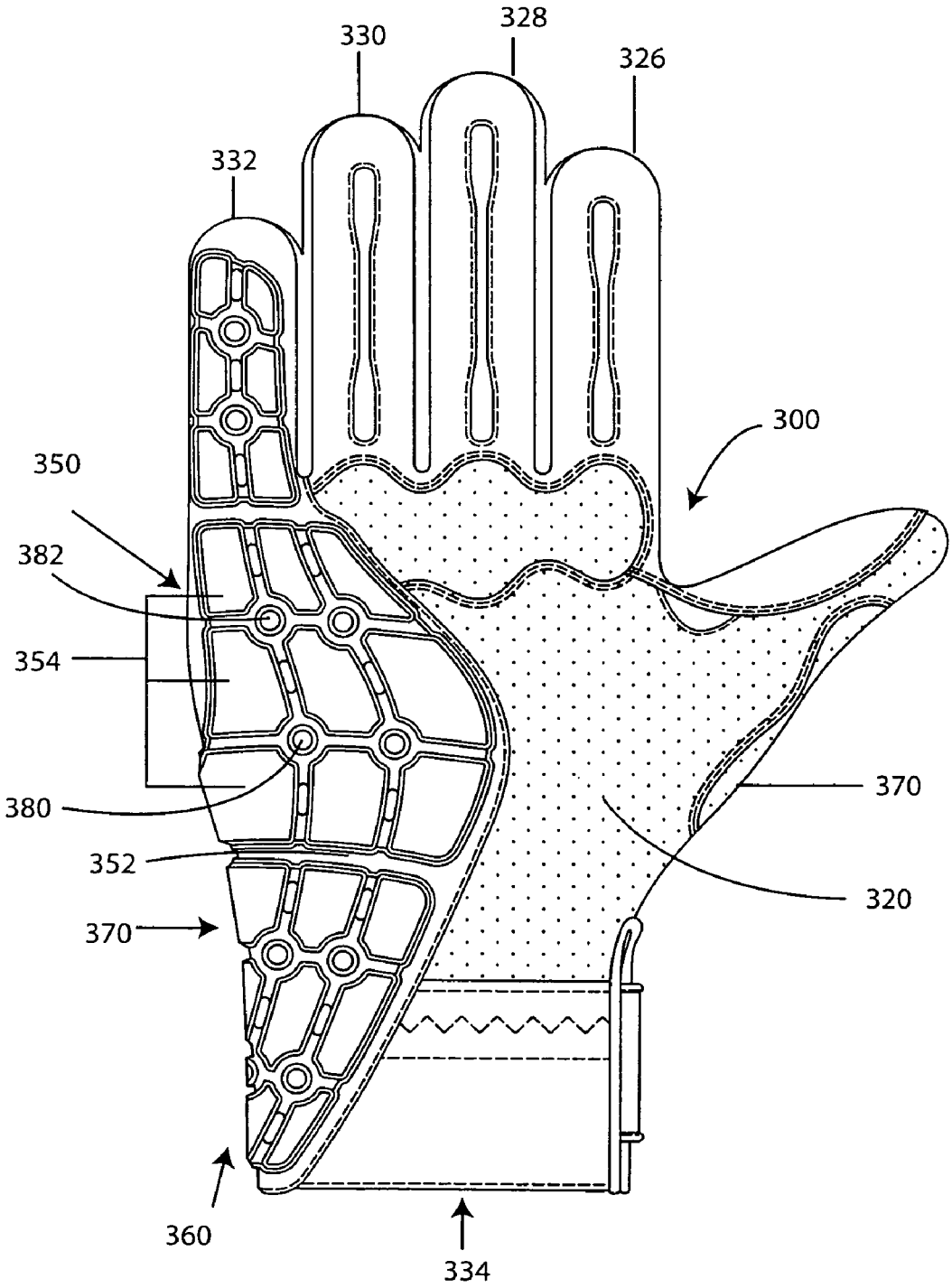
FIG. 18 is a top plan view of a third embodiment of the BASEBALL BATTING GLOVE WITH PROTECTIVE SHOCK ABSORBING MEMBERS ON THE EXTERIOR OF THE GLOVE which is a left handed glove for a left handed batter.
Figure 19:
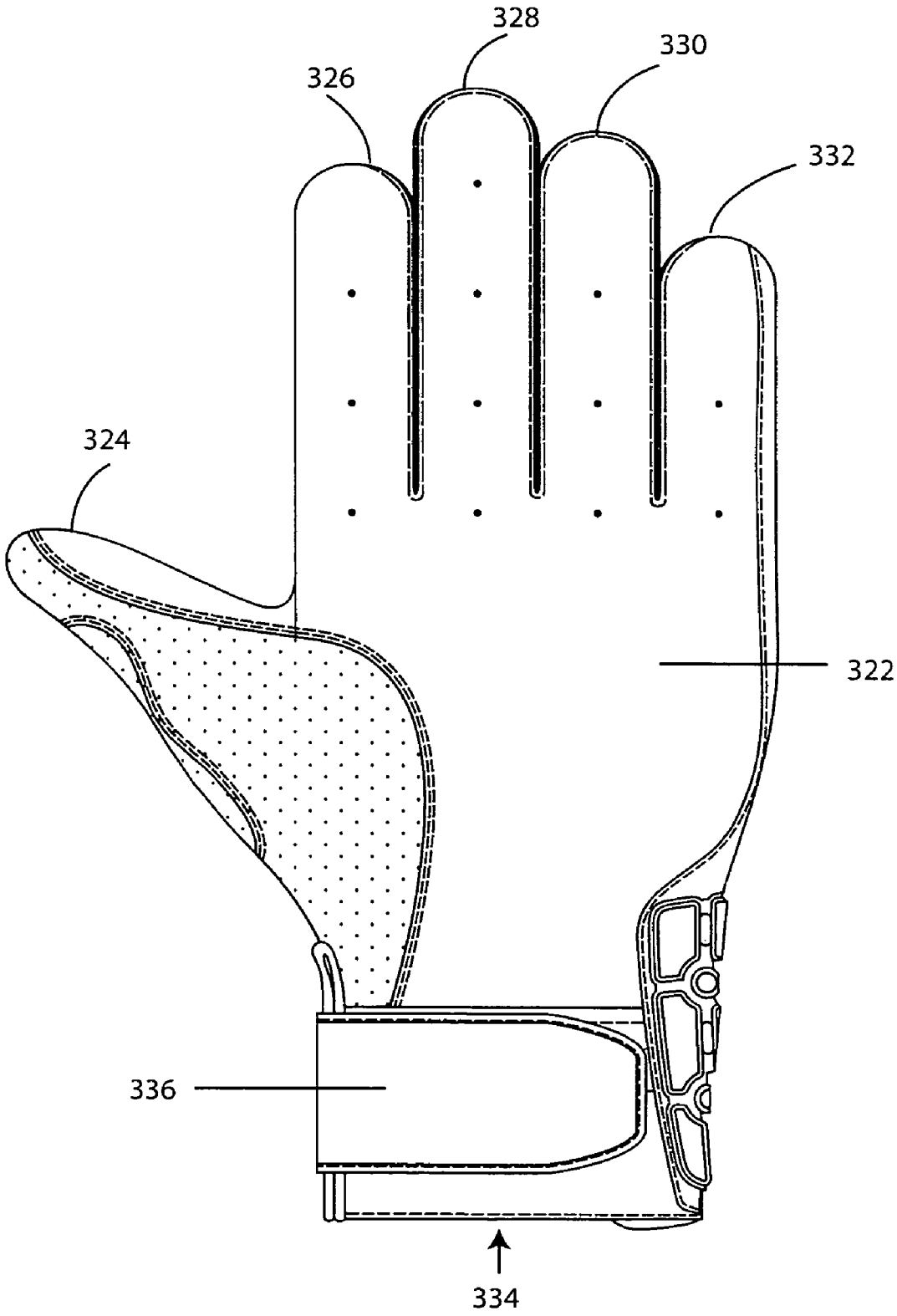
FIG. 19 is a bottom plan of the third embodiment.
Figure 20:
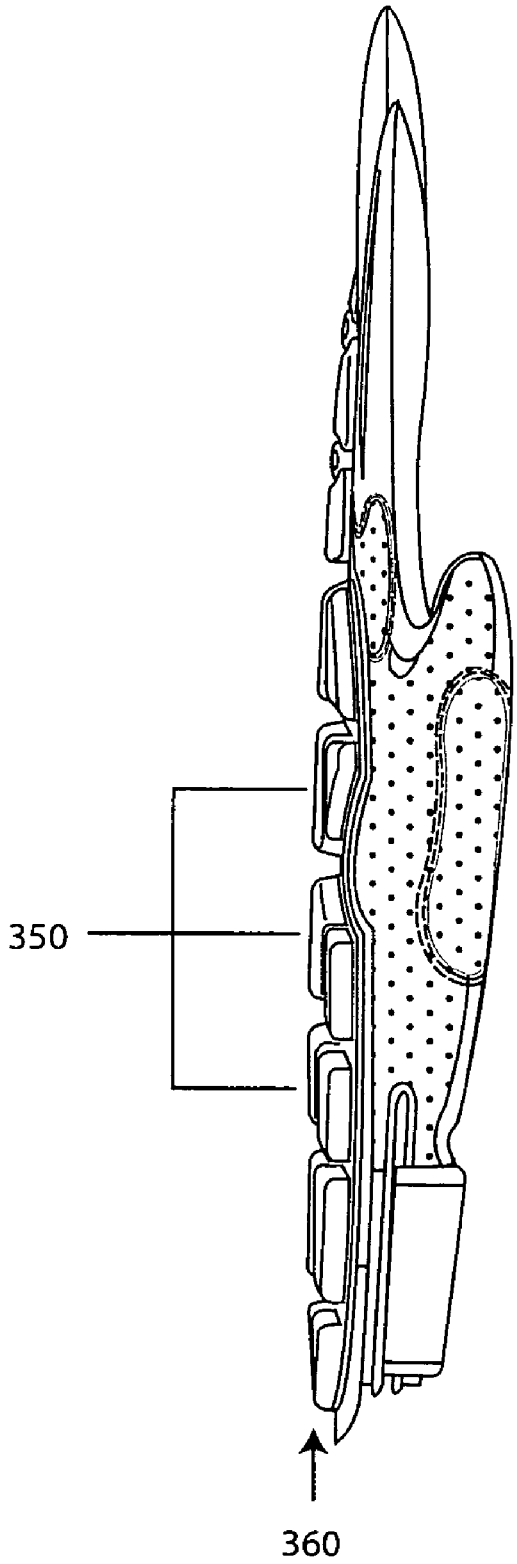
FIG. 20 is a side elevational view when viewed from the right side of the third embodiment.
Figure 21:
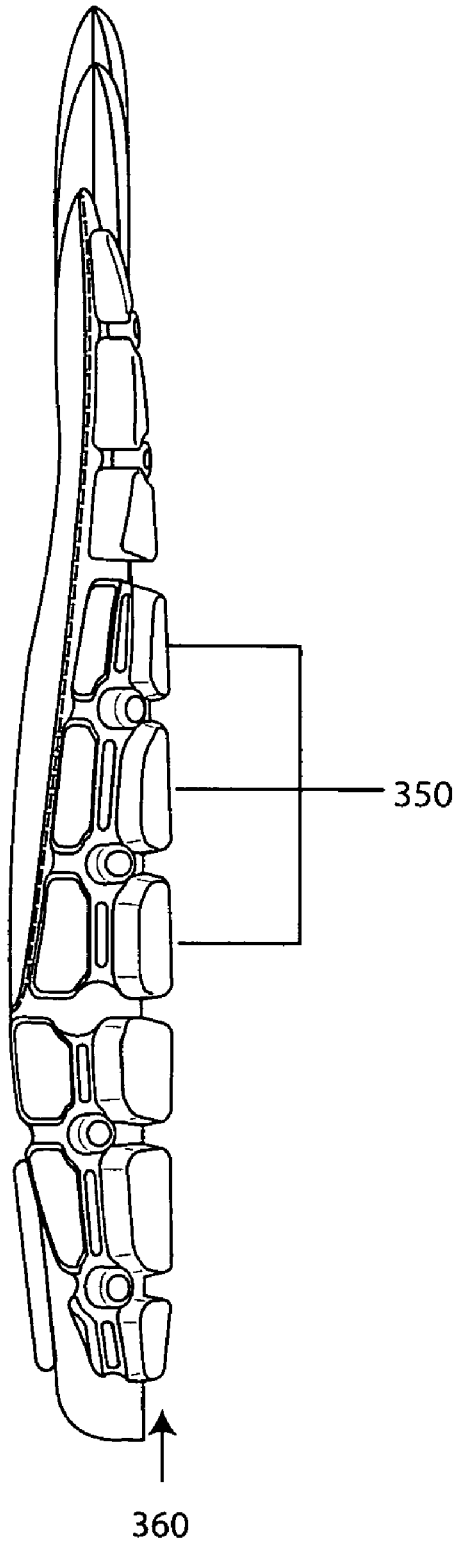
FIG. 21 is a side elevational view when viewed from the left side of the third embodiment.
Figure 22:
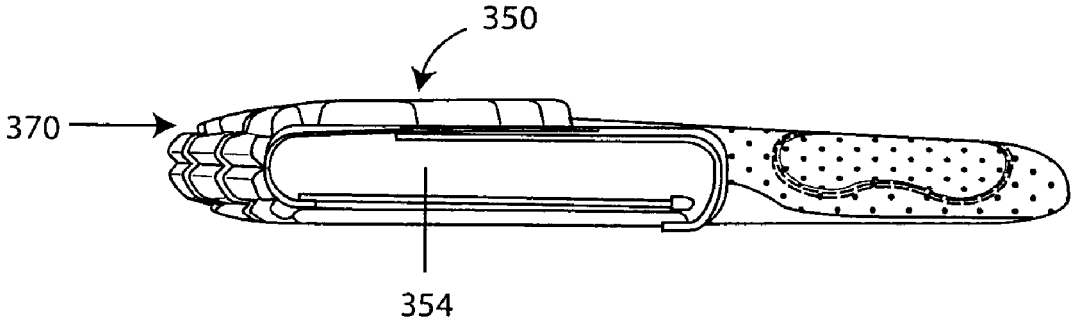
FIG. 22 is a bottom end view of the third embodiment.
Figure 23:
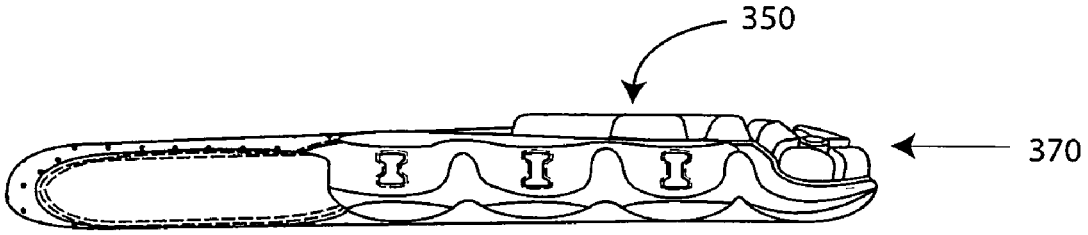
FIG. 23 is a top end view of the third embodiment.
Figure 24:
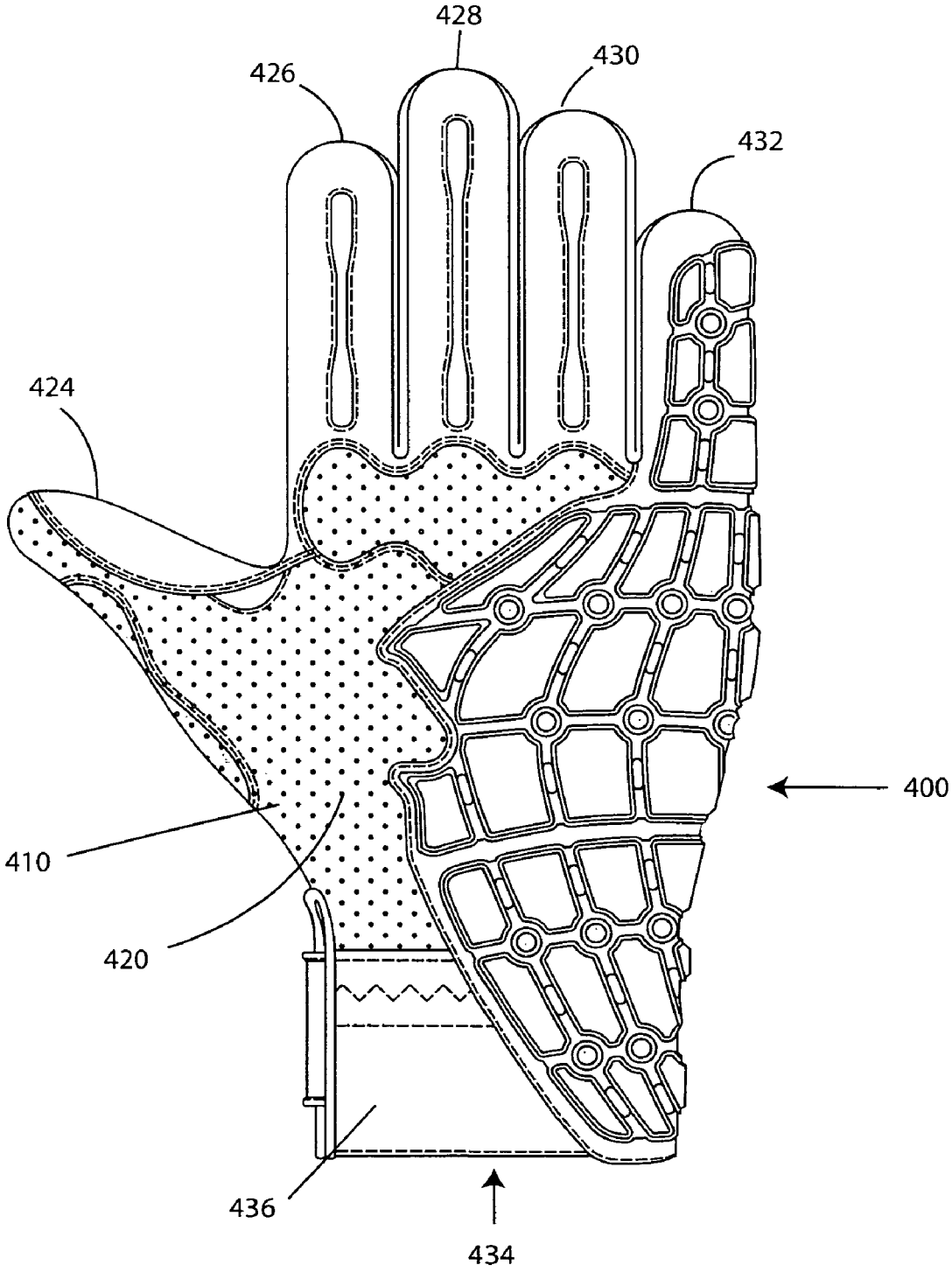
FIG. 24 is a top plan view of a fourth embodiment of the BASEBALL BATTING GLOVE WITH PROTECTIVE SHOCK ABSORBING MEMBERS ON THE EXTERIOR OF THE GLOVE which is a right handed glove used by a left handed batter.
Figure 25:
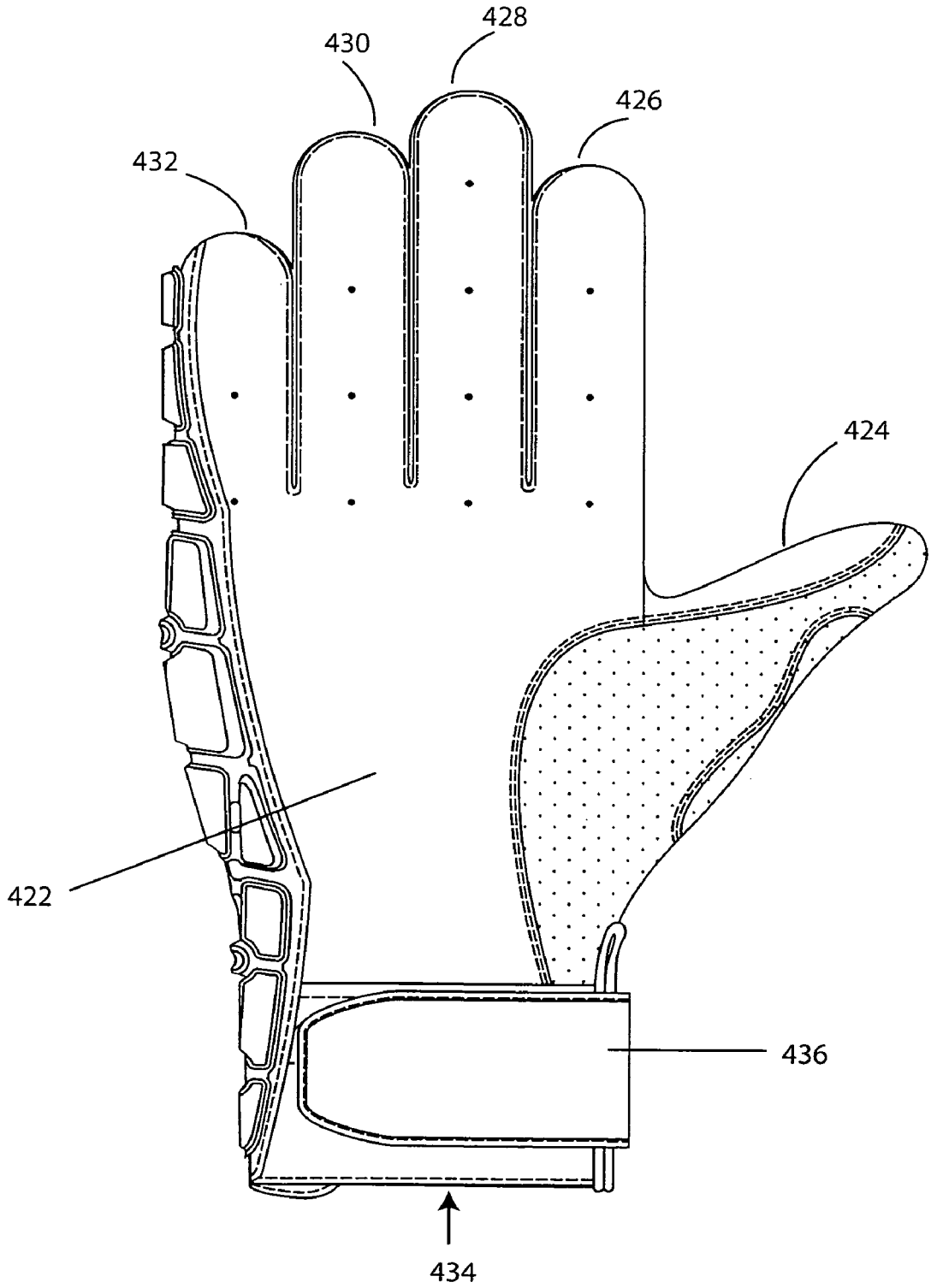
FIG. 25 is a bottom plan of the fourth embodiment.
Figure 26:
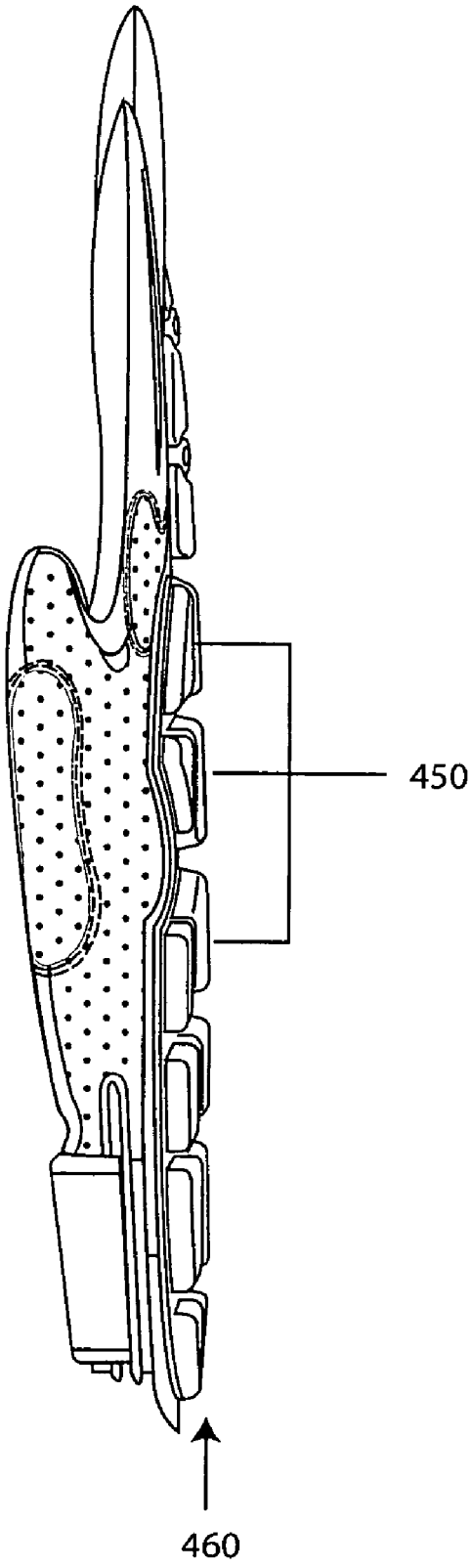
FIG. 26 is a side elevational view when viewed from the left side of the fourth embodiment.
Figure 27:
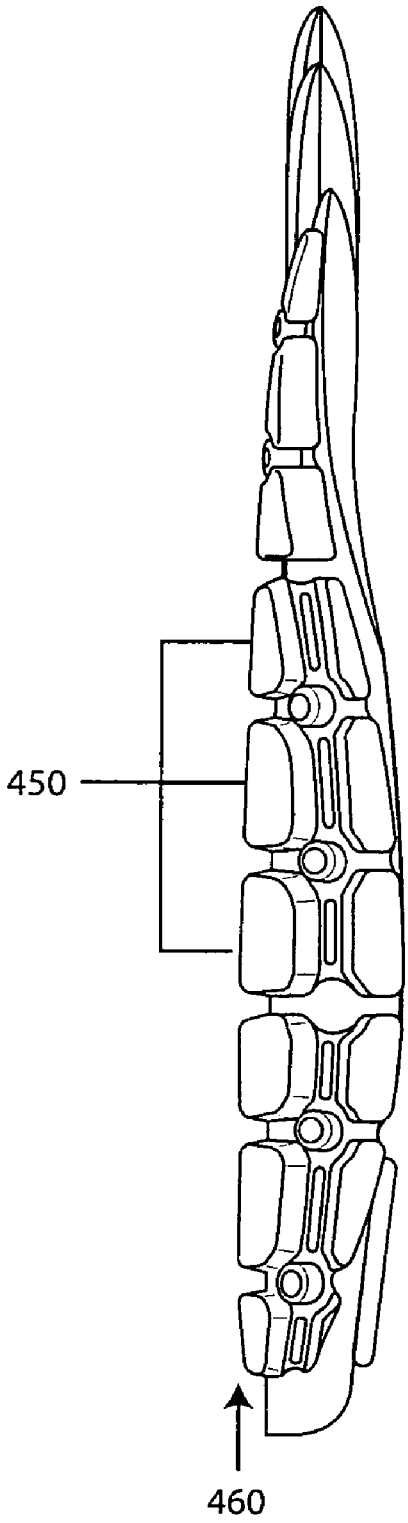
FIG. 27 is a side elevational view when viewed from the right side of the fourth embodiment.
Figure 28:
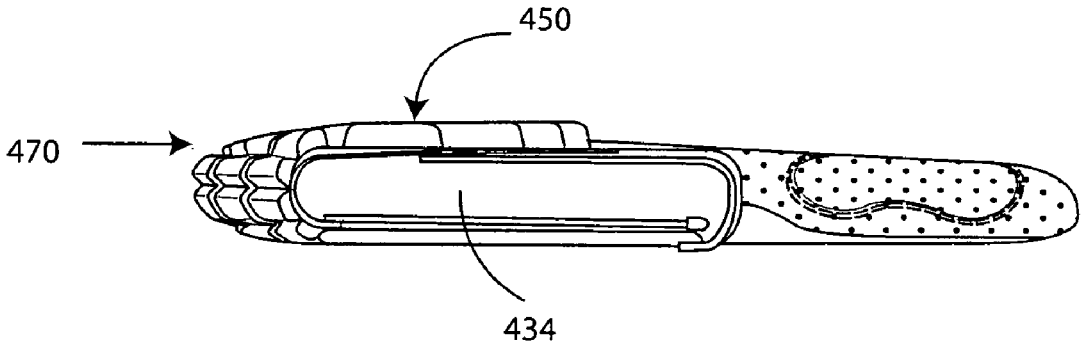
FIG. 28 is a bottom end view of the fourth embodiment.
Figure 29:
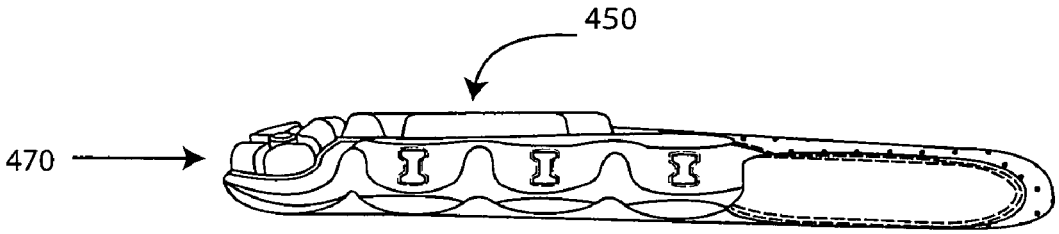
FIG. 29 is a top end view of the fourth embodiment.

The right handed and left handed gloves for a right handed batter with the present invention are shown in use while gripping baseball bat 1000 as illustrated in FIGS. 15, 16 and 17. The right forearm 1110 is shown in dotted lines and the left forearm 1120 is shown in dotted lines. The right handed glove 100 is above the left handed glove 200. As illustrated in FIG. 15, the gloves 100 and 200 are matched so that the shock absorbing matrixes 150 and 250 of each glove will be exposed in the direction of a thrown ball when a batter is gripping the baseball bat 1000 and during and after completion of a swing of a bat. The gloves are designed so that the area of the left handed glove 200 adjacent the right handed glove 100 does not have shock absorbing material on it so that there is a smooth fit at the adjacent location of the two gloves as the batter grips the baseball bat 1000. This design facilitates the batter gripping the bat in the normal way and the shock absorbing material does not interfere with the way the batter grips the baseball bat. In this way, the primary right hand glove 100 which has the impact and energy absorbing matrix 150 is positioned at a location so that the impact and energy absorbing cells 154 are positioned to receive an impact of a baseball if the batter raises his right had to protect himself or if the swing is completed or partially completed so this portion of the glove faces the oncoming baseball. Therefore, through the present invention, the most vulnerable bones on the fingers, hand and wrist are protected. As illustrated in FIG. 15, the shock absorbing members 154 from the right handed glove 100 are positioned to protect the batter's hands and wrist at its most vulnerable position when the batter is standing at home plate to await a pitch. FIG. 16 shows the bat raised by a batter in a normal reaction if a ball appears to be coming at the batter, so that the batter's face and head are protected with the shock absorbing material from the right handed glove facing the oncoming ball. FIG. 17 shows that if a batter misjudges a pitch and the batter's hands are facing an oncoming ball during a swing, the shock absorbing material on the right handed glove is facing the oncoming ball protect the most vulnerable parts of the batter's hand and wrist. The left hand glove 200 also has shock absorbing material to protect the corresponding vulnerable bones on the left hand.

Referring to FIGS. 18 through 29 there is illustrated a pair of protective baseball bating gloves for use by a left handed batter in accordance with the present invention. The glove worn on the left hand is illustrated in FIGS. 18 through 23. The left handed glove 300 for a left handed batter is made of breathable synthetic or leather material such as leather, synthetic leather and stretchable nylon and includes a body 310 have a back section 320 which covers the back the hand and a palm section 322. The back section 320 and palm section 322 extend to finger receiving sections including a thumb receiving section 324, a forefinger receiving section 326, a middle finger receiving section 328, a fourth finger receiving section 330 and a pinkie finger receiving section 332. The rear or bottom of the glove 300 has an opening 334 through which the right hand and fingers are inserted so that a thumb and respective finger are respectively received within the a respective thumb receiving section and finger receiving sections. An adjustment or tightening strap 336 is located adjacent the bottom opening 334 to tighten the glove 300 around the wrist of the wearer. The glove is long enough so that the shock absorbing cells 354 can cover the wrist bones and a portion of the ulna bone.

The improvement of the present invention is the addition of a flexible matrix 350 of impact and shock absorbing cells 354 which are formed on an interconnecting layer 352 and comprise a multiplicity of impact and shock absorbing cells 354 which are formed in spaced apart longitudinal rows 360 and transverse rows 370, each shock absorbing cell attached onto the interconnecting layer 352 and separated from adjacent shock absorbing cells by a gap, the design also including a circular shock absorbing post 380 attached to the interconnecting layer 352 and at a location of a corner of each respective four spaced apart shock absorbing cells having a corner closest to each other. Each shock absorbing post 380 has a central opening 382.

The preferred embodiment of the glove and shock absorbing material formation is the same as illustrated in the cross-sectional view of FIG. 33. The glove layer has a substrate material sewn into the glove material. The glove layer can be made of leather, synthetic leather, stretchable nylon, etc. The substrate material can also be made of leather, synthetic leather, stretchable nylon, etc. A thermoplastic bonding layer is bonded to the substrate layer and the impact absorbing cells are bonded to the thermoplastic layer. One method to create the bonding is radio frequency bonding. A conducting agent is placed between the substrate layer 104 and the thermoplastic bonding layer and another conducting agent is placed between the thermoplastic bonding layer and the impact absorbing cell and the entire assembly is bonded together by radio frequency bonding. As illustrated in FIGS. 18 through 23, a multiplicity of gaps 362 are formed between the shock absorbing cells 354 and a multiplicity of shock absorbing posts 380 with central openings 382 are also formed. The gaps and posts enhance the flexibility of the gloves. In one preferred embodiment, the shock absorbing cells 354 are made of material selected from the group consisting of a soft polyvinyl chloride foam, soft polyvinyl chloride solid material, silicone foam, silicone solid material, flexible thermoplastic foam, flexible thermoplastic solid material, and flexible thermoplastic rubber.

As illustrated in FIGS. 18 through 23, the flexible matrix 350 of shock absorbing cells 354 is on the outside or exterior surface of the glove 300 and extends over the area of the pinkie finger receiving section 332 and cover the entire length of the glove so as to cover the area of the glove which receives the pinkie finger including its three phalanges—proximal 14, middle 15 and distal 16 and the metacarpal bone 13 of the hand aligned with the pinkie finger. Preferably the matrix 350 of shock absorbing cells 354 also covers the metacarpal bone 12 of the hand associated with the fourth finger and the metacarpal bone 11 of the hand associated with the middle finger. The key innovation of the present invention is that the matrix of shock absorbing cells 350 extend over the area of the glove to cover a portion of the wrist bones aligned with the pinkie finger cover the wrist bones and may also cover a portion of the ulna bone. The wrist bones which are thereby covered are the carpal bones which are the hamate 8, trequetrum 3, pisiform 4, and lunate 2. The capitate bone 7 can also be covered.

The key innovation of the present invention is that the matrix 350 of shock absorbing cells 354 is on the exterior of the glove 300 and at least covers the bone of the hand aligned with the pinkie finger which is the metacarpal bone 13 and at least covers the bones of the wrist aligned with this metacarpal bone 13 which bones are at least the hamate 8, the triquetrum 3 and the pisiform 4. Preferably the shock absorbing matrix 350 also covers the ulna bone 17 at its location adjacent the wrist. Although there are gaps to provide flexibility, the impact and shock absorbing protection is continuous to cover the metacarpal bone 13 on its top, side and bottom and to cover the exposed top of the wrist bones. In this way, the bones which are most vulnerable to being hit by a pitch are covered and protected. Injury to these bones can be career ending or at least cause a player to be sidelined and undergo recovery for many weeks or months.

The glove worn on the right hand for a left handed batter is illustrated in FIGS. 24 through 29. The right handed glove 400 for a left handed batter is made of breathable synthetic or leather material such as leather, synthetic leather and stretchable nylon and includes a body 410 have a top or back section 420 which covers the back the hand and a palm section 422. The back section 420 and palm section 422 extend to finger receiving sections including a thumb receiving section 424, a forefinger receiving section 426, a middle finger receiving section 428, a fourth finger receiving section 430 and a pinkie finger receiving section 432. The rear or bottom of the glove 400 has an opening 434 through which the left hand and fingers are inserted so that a thumb and respective finger are respectively received within the a respective thumb receiving section and finger receiving sections. An adjustment or tightening strap 436 is located adjacent the bottom opening 434 to tighten the glove 400 around the wrist of the wearer. The glove is long enough to cover the wrist bones and the ulna bone.

The improvement of the present invention is the addition of a flexible matrix 450 of impact and shock absorbing cells 454 which are formed on an interconnecting layer 452 and comprise a multiplicity of impact and shock absorbing cells 454 which are formed in spaced apart longitudinal rows 460 and transverse rows 470, each shock absorbing cell attached onto the interconnecting layer 452 and separated from adjacent shock absorbing cells by a gap, the design also including a circular shock absorbing post 480 attached to the interconnecting layer 452 and at a location of a corner of each respective four spaced apart shock absorbing cells having a corner closest to each other. Each shock absorbing post 480 has a central opening 482.

The preferred embodiment of the glove and shock absorbing material formation is illustrated in the cross-sectional view of FIG. 33 and the formation is the same for the right handed glove as for the right handed glove. The glove layer has a substrate material sewn into the glove material. The glove layer can be made of leather, synthetic leather, stretchable nylon, etc. The substrate material can also be made of leather, synthetic leather, stretchable nylon, etc. A thermoplastic bonding layer is bonded to the substrate layer and the impact absorbing cells are bonded to the thermoplastic layer. One method to create the bonding is radio frequency bonding. A conducting agent is placed between the substrate layer and the thermoplastic bonding layer and another conducting agent is placed between the thermoplastic bonding layer and the impact absorbing cell and the entire assembly is bonded together by radio frequency bonding. As illustrated in FIGS. 24 through 29, a multiplicity of gaps 462 are formed between the shock absorbing cells 454 and a multiplicity of shock absorbing posts 480 with central openings 482 are also formed. The gaps and posts enhance the flexibility of the gloves. In preferred embodiments, the impact and shock absorbing cells 154 are made of material selected from the group consisting of a soft polyvinyl chloride foam, soft polyvinyl chloride solid material, silicone foam, silicone solid material, flexible thermoplastic foam, flexible thermoplastic solid material, and flexible thermoplastic rubber.

As illustrated in FIGS. 24 through 29, the flexible matrix 450 of shock absorbing cells 454 is on the outside or exterior surface of the glove 400 and extends over the area of the pinkie finger receiving section 432 and cover the entire length of the glove so as to cover the area of the glove which receives the pinkie finger including its three phalanges—proximal 14, middle 15 and distal 16 and the metacarpal bone 13 of the hand aligned with the pinkie finger. Preferably the matrix 450 of shock absorbing cells 454 also covers the metacarpal bone 12 of the hand associated with the fourth finger and the metacarpal bone 11 of the hand associated with the middle finger. The key innovation of the present invention is that the matrix 450 of shock absorbing cells 454 extend over the area of the glove to cover a portion of the wrist bones aligned with the pinkie finger cover the wrist bones and may also cover the ulna bone. The wrist bones which are thereby covered are the carpal bones which are the hamate 8, trequetrum 3, pisiform 4, and lunate 2. The capitate bone 7 can also be covered.

The key innovation of the present invention is that the matrix 450 of shock absorbing cells 454 is on the exterior of the glove 400 and at least covers the bone of the hand aligned with the pinkie finger which is the metacarpal bone 13 and at least covers the bones of the wrist aligned with this metacarpal bone 13 which bones are at least the hamate 8, the triquetrum 3 and the pisiform 4. Preferably the shock absorbing matrix 450 also covers the ulna bone 17 at its location adjacent the wrist. Although there are gaps to provide flexibility, the impact and shock absorbing protection is continuous to cover the metacarpal bone 13 on its top, side and bottom and to cover the exposed top of the wrist bones. In this way, the bones which are most vulnerable to being hit by a pitch are covered and protected. Injury to these bones can be career ending or at least cause a player to be sidelined and undergo recovery for many weeks or months.

Figure 30:
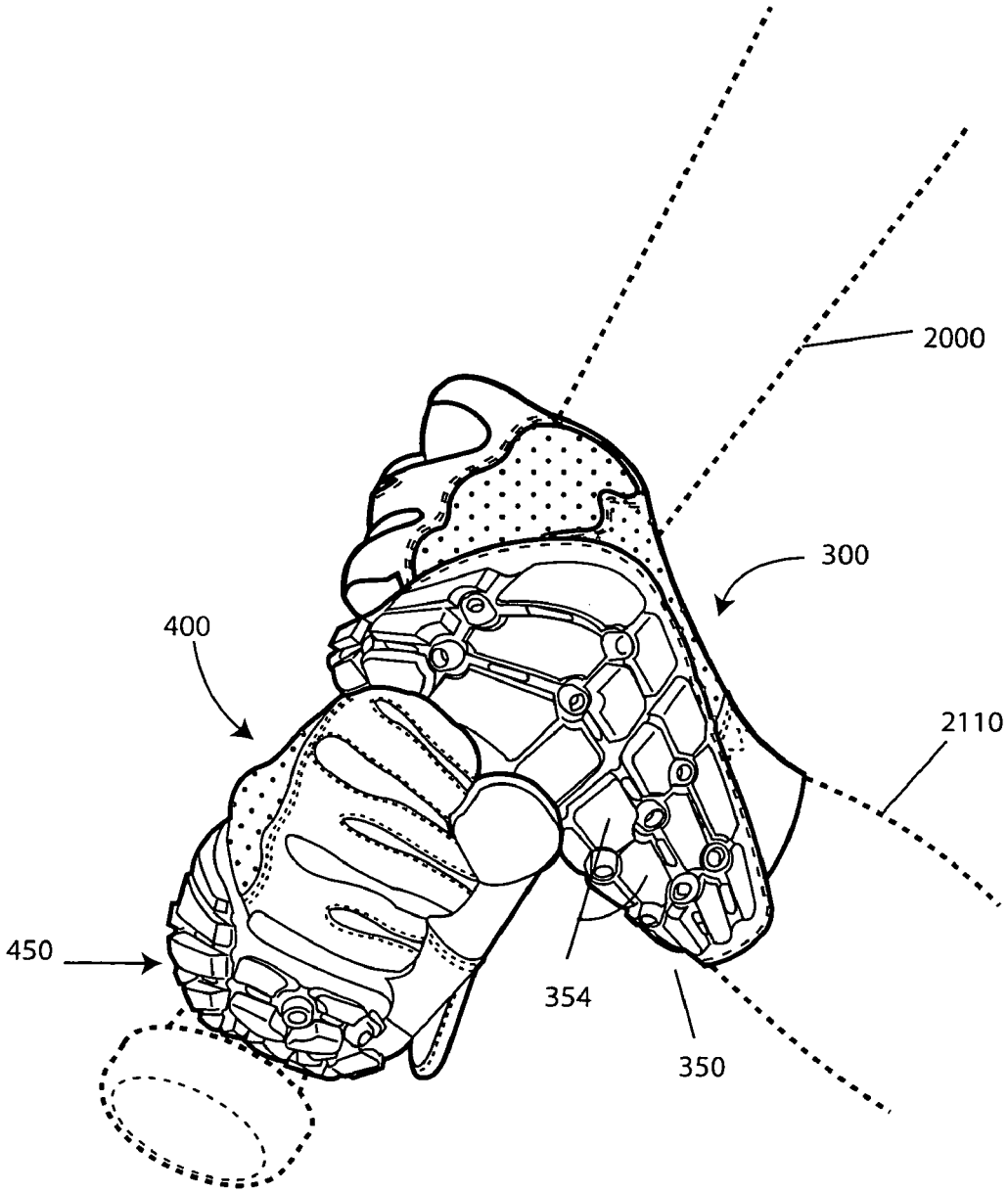
FIG. 30 is a perspective view of the third and fourth embodiments of the present invention as worn by a left handed batter when gripping the bottom end of a baseball bat while standing at home plate to await a pitch, the baseball bat is shown in dotted lines and is not a part of this invention and a portion of a batter's arm is also shown in dotted lines and is not a part of this invention.
Figure 31:
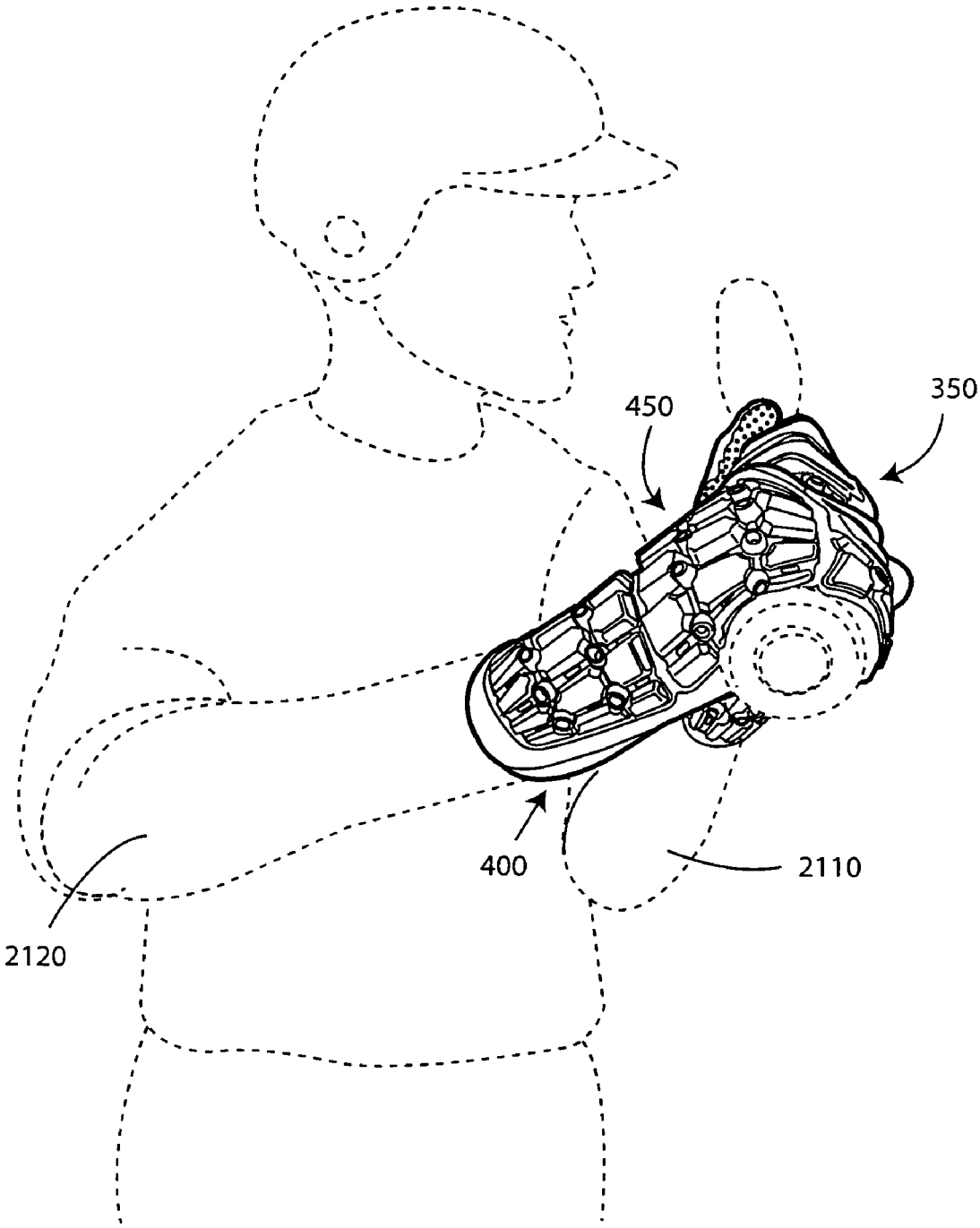
FIG. 31 is a perspective view of the third and fourth embodiments of the present invention as worn by a left handed batter when gripping the bottom end of a baseball bat with the bat raised by the batter to protect his face and head from a baseball coming in a direction which will hit the batter, with both gloves having impact and shock absorbing material to protect the batter in various orientations depending on how the batter moves. The baseball bat is shown in dotted lines and is not a part of this invention and the batter is also shown in dotted lines and is not a part of this invention.
Figure 32:
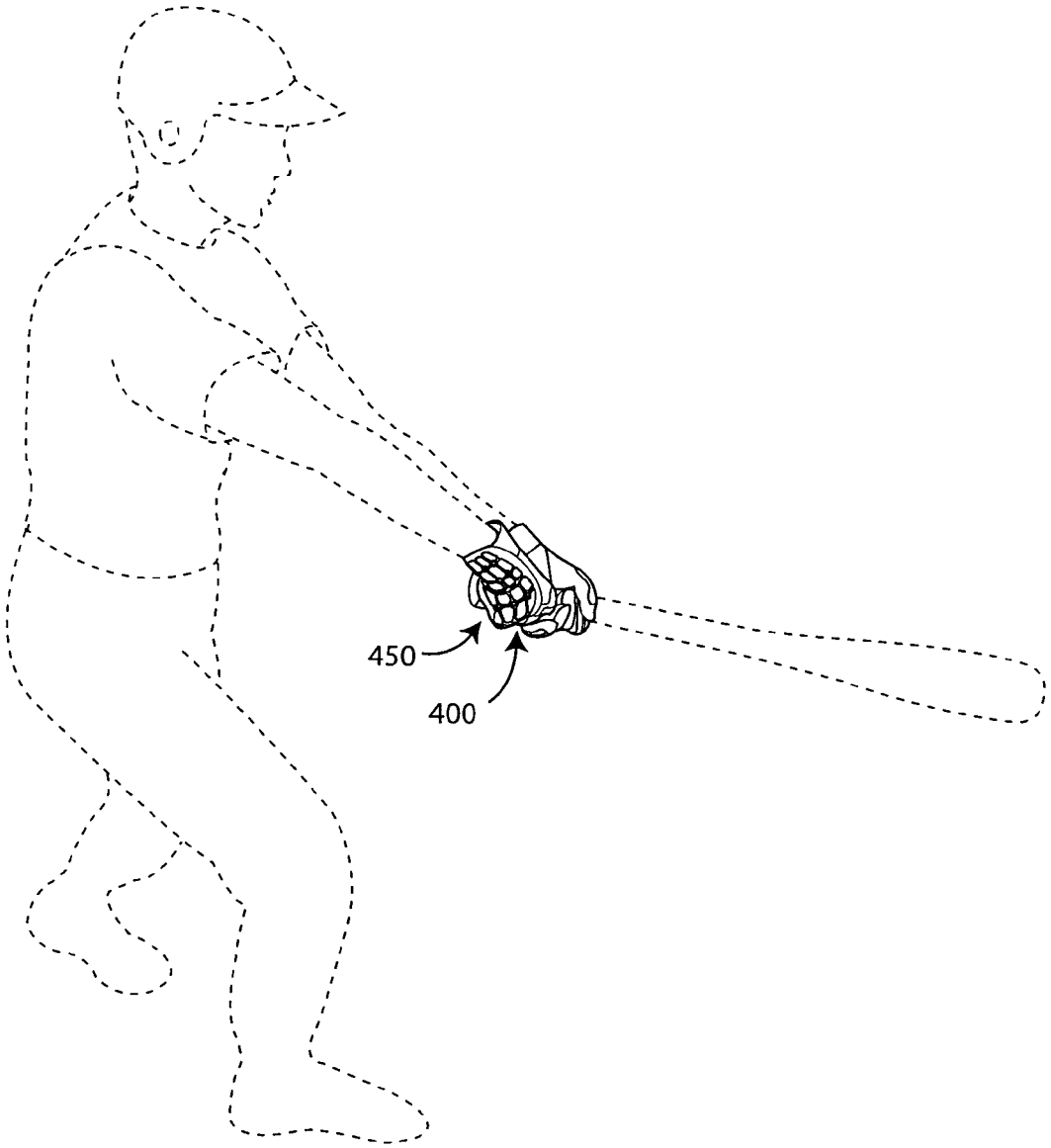
FIG. 32 is a perspective view of the third and fourth embodiments of the present invention as worn by a left handed batter when gripping the bottom end of a baseball bat being swung in the middle of a swing with a baseball coming in the direction of the batter's hands during the swing, with both gloves having impact and shock absorbing material to protect the batter in various swing positions. The baseball bat is shown in dotted lines and is not a part of this invention and a portion of a batter's arm is also shown in dotted lines and is not a part of this invention.

The left handed and right handed gloves for a left handed batter with the present invention are shown in use while gripping baseball bat 2000 as illustrated in FIGS. 30, 31 and 32. The left forearm 2110 is shown in dotted lines and the right forearm 2120 is shown in dotted lines. The left handed glove 300 is above the right handed glove 400. As illustrated in FIG. 30, the gloves 300 and 400 are matched so that the shock absorbing matrixes 350 and 450 of each glove will be exposed in the direction of a thrown ball when a batter is gripping the baseball bat 2000 and during and after completion of a swing of a bat. The gloves are designed so that the area of the right handed glove 400 adjacent the left handed glove 300 does not have shock absorbing material on it so that there is a smooth fit at the adjacent location of the two gloves as the batter grips the baseball bat 2000. This design facilitates the batter gripping the bat in the normal way and the shock absorbing material does not interfere with the way the batter grips the baseball bat. In this way, the primary right hand glove 300 which has the impact and energy absorbing matrix 350 is positioned at a location so that the impact and energy absorbing cells 354 are positioned to receive an impact of a baseball if the batter raises his right had to protect himself or if the swing is completed or partially completed so this portion of the glove faces the oncoming baseball. Therefore, through the present invention, the most vulnerable bones on the fingers, hand and wrist are protected. As illustrated in FIG. 30, the shock absorbing members 354 from the left handed glove 300 are positioned to protect the batter's hands and wrist at its most vulnerable position when the batter is standing at home plate to await a pitch. FIG. 31 shows the bat raised by a batter in a normal reaction if a ball appears to be coming at the batter, so that the batter's face and head are protected with the shock absorbing material from the right handed glove facing the oncoming ball. FIG. 32 shows that if a batter misjudges a pitch and the batter's hands are facing an oncoming ball during a swing, the shock absorbing material on the right handed glove is facing the oncoming ball protect the most vulnerable parts of the batter's hand and wrist. The right handed glove 400 also has shock absorbing material to protect the corresponding vulnerable bones in the right hand.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A pair of protective gloves to be respectively worn on a right hand and a left hand of a right handed batter when gripping a baseball bat, each hand having a thumb, a forefinger, a middle finger, a fourth finger and a pinkie finger, the bones in the pinkie finger including a proximal phalanges, a middle phalanges, and a distal phalanges, the bones in each hand respectively having a metacarpal bone aligned with the pinkie finger of that hand, each hand extending to a wrist which includes at least a hamate bone, a triquetrum bone and a pisiform bone aligned with the metacarpal bone in the hand which is aligned with the bones of the pinkie finger of that hand, the protective gloves comprising:

a. a right handed glove having a body including a back section which covers a back of the right hand, a palm section which covers a palm section of a right hand, the palm section and back section extending into finger receiving sections including a thumb receiving section, a forefinger receiving section, a middle finger receiving section, a fourth finger receiving section and a pinkie finger receiving section, an opening in a bottom of the glove through which a right hand is inserted into an interior of the glove, the glove having an exterior surface to which a flexible matrix of impact and shock absorbing cells are affixed and comprise a multiplicity of spaced apart impact and shock absorbing cells which are positioned on the exterior surface of the glove, said cells are formed in spaced apart longitudinal rows and transverse rows, each shock absorbing cell is separated from adjacent shock absorbing cells by a gap, a circular shock absorbing post having a central opening attached to the exterior surface and at a location of a corner of each respective four spaced apart shock absorbing cells having a corner closest to each other, said cells protect the metacarpal bone of the right hand aligned with the bones of the pinkie finger, and the hamate bone, the triquetrum bone and the pisiform bone aligned with the metacarpal bone in the hand which is aligned with the bones of the pinkie finger of the right hand;

b. a left handed glove has a body including a back section which covers a back of the left hand, a palm section which covers a palm section of a left hand, the palm section and back section extending into finger receiving sections including a thumb receiving section, a forefinger receiving section, a middle finger receiving section, a fourth finger receiving section and a pinkie finger receiving section, an opening in a bottom of the glove through which a left hand is inserted into an interior of the glove, the glove having an exterior surface which does not having impact and shock absorbing cells on the exterior surface which covers the thumb and forefinger of the left hand; and c. the pair of gloves used to grip a baseball bat with the right hand placed above the left hand on the bat so that the impact and shock absorbing members on the right handed glove are positioned to face a baseball thrown at the batter and the left handed glove does not interfere with the position of the impact and shock absorbing members on the right handed glove to thereby facilitate gripping of the baseball bat.

2. The pair of protective gloves in accordance with claim 1, further comprising the right handed glove having an exterior surface to which a flexible matrix of impact and shock absorbing cells are affixed and comprise a multiplicity of spaced apart impact and shock absorbing cells which are positioned on the exterior surface of the glove to protect the proximal phalanges, middle phalanges and distal phalanges bones of the pinkie finger.

3. The pair of protective gloves in accordance with claim 2, the right handed glove further comprising a substrate material sewn into the glove, a thermoplastic bonding layer bonded to the substrate layer, and the matrix of impact and shock absorbing cells bonded to the thermoplastic layer to protect the proximal phalanges, middle phalanges and distal phalanges bones of the pinkie finger, the metacarpal bone of the right hand aligned with the bones of the pinkie finger, and the hamate bone, the triquetrum bone and the pisiform bone aligned with the metacarpal bone in the hand which is aligned with the bones of the pinkie finger of the right hand.

4. The pair of protective gloves in accordance with claim 1, wherein each cell in the matrix of impact and shock absorbing cells is made of material selected from the group consisting of a soft polyvinyl chloride foam, soft polyvinyl chloride solid material, silicone foam, silicone solid material, flexible thermoplastic foam, flexible thermoplastic solid material, and flexible thermoplastic rubber.

5. The pair of protective gloves in accordance with claim 1 wherein the left handed glove has an exterior surface to which a flexible matrix of impact and shock absorbing cells are affixed and comprise a multiplicity of spaced apart impact and shock absorbing cells which are positioned on the exterior surface of the glove to protect at least the metacarpal bone of the left hand aligned with the bones of the pinkie finger, and the hamate bone, the triquetrum bone and the pisiform bone aligned with the metacarpal bone in the hand which is aligned with the bones of the pinkie finger of the left hand.

6. The pair of protective gloves in accordance with claim 1, wherein the flexible matrix of impact and shock absorbing cells are affixed and comprise a multiplicity of spaced apart impact and shock absorbing cells which are positioned on the exterior surface of the right handed glove to protect the metacarpal bones of the right hand aligned with the bones of the pinkie finger, fourth finger and middle finger.

7. The pair of protective gloves in accordance with claim 6, wherein the flexible matrix of impact and shock absorbing cells are affixed and comprise a multiplicity of spaced apart impact and shock absorbing cells which are positioned on the exterior surface of the right handed glove to further protect additional bones of a wrist adjacent the right hand including a lunate bone and a capitate bone.

8. The pair of protective gloves in accordance with claim 7, wherein the flexible matrix of impact and shock absorbing cells are affixed and comprise a multiplicity of spaced apart impact and shock absorbing cells which are positioned on the exterior surface of the right handed glove to further protect a portion of an ulna bone of a right arm.

9. A pair of protective gloves to be respectively worn on a left hand and a right hand of a left handed batter when gripping a baseball bat, each hand having a thumb, a forefinger, a middle finger, a fourth finger and a pinkie finger, the bones in the pinkie finger including a proximal phalanges, a middle phalanges, and a distal phalanges, the bones in each hand respectively having a metacarpal bone aligned with the pinkie finger of that hand, each hand extending to a wrist which includes at least a hamate bone, a triquetrum bone and a pisiform bone aligned with the metacarpal bone in the hand which is aligned with the bones of the pinkie finger of that hand, the protective gloves comprising:

a. a left handed glove having a body including a back section which covers a back of the left hand, a palm section which covers a palm section of a left hand, the palm section and back section extending into finger receiving sections including a thumb receiving section, a forefinger receiving section, a middle finger receiving section, a fourth finger receiving section and a pinkie finger receiving section, an opening in a bottom of the glove through which a left hand is inserted into an interior of the glove, the glove having an exterior surface to which a flexible matrix of impact and shock absorbing cells are affixed and comprise a multiplicity of spaced apart impact and shock absorbing cells which are positioned on the exterior surface of the glove, said cells are formed in spaced apart longitudinal rows and transverse rows, each shock absorbing cell is separated from adjacent shock absorbing cells by a gap, a circular shock absorbing post having a central opening attached to the exterior surface and at a location of a corner of each respective four spaced apart shock absorbing cells having a corner closest to each other, said cells protect the metacarpal bone of the left hand aligned with the bones of the pinkie finger, and the hamate bone, the triquetrum bone and the pisiform bone aligned with the metacarpal bone in the hand which is aligned with the bones of the pinkie finger of the left hand;

b. a right handed glove having a body including a back section which covers a back of the right hand, a palm section which covers a palm section of a right hand, the palm section and back section extending into finger receiving sections including a thumb receiving section, a forefinger receiving section, a middle finger receiving section, a fourth finger receiving section and a pinkie finger receiving section, an opening in a bottom of the glove through which a right hand is inserted into an interior of the glove, the glove having an exterior surface which does not having impact and shock absorbing cells on the exterior surface which covers the thumb and forefinger of the right hand; and c. the pair of gloves used to grip a baseball bat with the left hand placed above the right hand on the bat so that the impact and shock absorbing members on the left handed glove are positioned to face a baseball thrown at the batter and the right handed glove does not interfere with the position of the impact and shock absorbing members on the right handed glove to thereby facilitate gripping of the baseball bat.

10. The pair of protective gloves in accordance with claim 9, further comprising the left handed glove having an exterior surface to which a flexible matrix of impact and shock absorbing cells are affixed and comprise a multiplicity of spaced apart impact and shock absorbing cells which are positioned on the exterior surface of the glove to protect the proximal phalanges, middle phalanges and distal phalanges bones of the pinkie finger.

11. The pair of protective gloves in accordance with claim 9, the left handed glove further comprising a substrate material sewn into the glove, a thermoplastic bonding layer bonded to the substrate layer, and the matrix of impact and shock absorbing cells bonded to the thermoplastic layer to protect the metacarpal bone of the left hand aligned with the bones of the pinkie finger, and the hamate bone, the triquetrum bone and the pisiform bone aligned with the metacarpal bone in the hand which is aligned with the bones of the pinkie finger of the left hand.

12. The pair of protective gloves in accordance with claim 9, wherein each cell in the matrix of impact and shock absorbing cells is made of material selected from the group consisting of a soft polyvinyl chloride foam, soft polyvinyl chloride solid material, silicone foam, silicone solid material, flexible thermoplastic foam, flexible thermoplastic solid material, and flexible thermoplastic rubber.

13. The pair of protective gloves in accordance with claim 9 wherein the right handed glove has an exterior surface to which a flexible matrix of impact and shock absorbing cells are affixed and comprise a multiplicity of spaced apart impact and shock absorbing cells which are positioned on the exterior surface of the glove to protect at least the metacarpal bone of the right hand aligned with the bones of the pinkie finger, and the hamate bone, the triquetrum bone and the pisiform bone aligned with the metacarpal bone in the hand which is aligned with the bones of the pinkie finger of the right hand.

14. The pair of protective gloves in accordance with claim 9, wherein the flexible matrix of impact and shock absorbing cells are affixed and comprise a multiplicity of spaced apart impact and shock absorbing cells which are positioned on the exterior surface of the left handed glove to protect the metacarpal bones of the left hand aligned with the bones of the pinkie finger, fourth finger and middle finger.

15. The pair of protective gloves in accordance with claim 14, wherein the flexible matrix of impact and shock absorbing cells are affixed and comprise a multiplicity of spaced apart impact and shock absorbing cells which are positioned on the exterior surface of the left handed glove to further protect additional bones of a wrist adjacent the right hand including a lunate bone and a capitate bone.

16. The pair of protective gloves in accordance with claim 15, wherein the flexible matrix of impact and shock absorbing cells are affixed and comprise a multiplicity of spaced apart impact and shock absorbing cells which are positioned on the exterior surface of the left handed glove to further protect a portion of an ulna bone of a left arm.

17. A protective glove to be worn on a hand of a batter when gripping a baseball bat, the hand having a thumb, a forefinger, a middle finger, a fourth finger and a pinkie finger, the bones in the pinkie finger including a proximal phalanges, a middle phalanges, and a distal phalanges, the bones in the hand having a metacarpal bone aligned with the pinkie finger of the hand, the hand extending to a wrist which includes at least a hamate bone, a triquetrum bone and a pisiform bone aligned with the metacarpal bone of the hand which is aligned with the bones of the pinkie finger of the hand, the protective glove comprising:

a. a body including a back section which covers a back of the hand, a palm section which covers a palm section of the hand, the palm section and back section extending into finger receiving sections including a thumb receiving section, a forefinger receiving section, a middle finger receiving section, a fourth finger receiving section and a pinkie finger receiving section, an opening in a bottom of the glove through which a hand is inserted into an interior of the glove, the glove having an exterior surface to which a flexible matrix of impact and shock absorbing cells are affixed and comprise a multiplicity of spaced apart impact and shock absorbing cells which are positioned on the exterior surface of the glove, wherein a circular shock absorbing post having a central opening attached to the exterior surface and at a location to adjacent spaced apart shock absorbing cells having a corner closest to each other, said cells protect the metacarpal bone of the hand aligned with the bones of the pinkie finger, and the hamate bone, the triquetrum bone and the pisiform bone aligned with the metacarpal bone in the hand which is aligned with the bones of the pinkie finger.

18. The protective glove in accordance with claim 17, further comprising an exterior surface to which a flexible matrix of impact and shock absorbing cells are affixed and comprise a multiplicity of spaced apart impact and shock absorbing cells which are positioned on the exterior surface of the glove to protect the proximal phalanges, middle phalanges and distal phalanges bones of the pinkie finger.

19. The protective glove in accordance with claim 17 further comprising a substrate material sewn into the glove, a thermoplastic bonding layer bonded to the substrate layer, and the matrix of impact and shock absorbing cells bonded to the thermoplastic layer to protect the metacarpal bone of the hand aligned with the bones of the pinkie finger, and the hamate bone, the triquetrum bone and the pisiform bone aligned with the metacarpal bone in the hand which is aligned with the bones of the pinkie finger of the hand.

20. The protective glove in accordance with claim 17, wherein each cell in the matrix of impact and shock absorbing cells is made of material selected from the group consisting of a soft polyvinyl chloride foam, soft polyvinyl chloride solid material, silicone foam, silicone solid material, flexible thermoplastic foam, flexible thermoplastic solid material, and flexible thermoplastic rubber.

21. The protective gloves in accordance with claim 17, wherein the flexible matrix of impact and shock absorbing cells are affixed and comprise a multiplicity of spaced apart impact and shock absorbing cells which are positioned on the exterior surface of the glove to protect the metacarpal bones of the hand aligned with the bones of the pinkie finger, fourth finger and middle finger.

22. The protective glove in accordance with claim 21, wherein the flexible matrix of impact and shock absorbing cells are affixed and comprise a multiplicity of spaced apart impact and shock absorbing cells which are positioned on the exterior surface of the glove to further protect additional bones of a wrist adjacent the hand including a lunate bone and a capitate bone.

23. The protective glove in accordance with claim 22, wherein the flexible matrix of impact and shock absorbing cells are affixed and comprise a multiplicity of spaced apart impact and shock absorbing cells which are positioned on the exterior surface of the glove to further protect a portion of an ulna bone of an arm which is adjacent the bones of the wrist being protected by the glove.

24. The protective glove in accordance with claim 17, wherein the glove is shaped to be worn on a right hand.

25. The protective glove in accordance with claim 17, wherein the glove is shaped to be worn on a left hand.

26. A protective glove to be worn on a hand of a batter when gripping a baseball bat, the hand having at least a pinkie finger including bones, the hand having a metacarpal bone aligned with the pinkie finger of the hand, the hand extending to a wrist which includes bones, the protective glove comprising:

a. a body which covers at least the pinkie finger and at least a portion of the hand and wrist, the body having an exterior surface to which a flexible matrix of impact and shock absorbing cells are affixed and comprise a multiplicity of spaced apart impact and shock absorbing cells which are positioned on the exterior surface of the body, a circular shock absorbing post having a central opening attached to the exterior surface and at a location to adjacent spaced apart shock absorbing cells having a corner closest to each other, said cells cover at least the metacarpal bone of the hand aligned with the bones of the pinkie finger.

27. The protective glove in accordance with claim 26, the body having an exterior surface to which a flexible matrix of impact and shock absorbing cells are affixed and comprise a multiplicity of spaced apart impact and shock absorbing cells which are positioned on the exterior surface of the body to additionally cover bones of the wrist aligned with the metacarpal bone of the hand which is aligned with the bones of the pinkie finger.

28. The protective glove in accordance with claim 27, wherein the flexible matrix of impact and shock absorbing cells are affixed and comprise a multiplicity of spaced apart impact and shock absorbing cells which are positioned on the exterior surface of the glove to further cover a portion of an ulna bone of an arm which is adjacent the bones of the wrist being protected by the glove.

29. The protective glove in accordance with claim 26 further comprising a substrate material sewn into the glove, a thermoplastic bonding layer bonded to the substrate layer, and the matrix of impact and shock absorbing cells bonded to the thermoplastic layer to protect at least the metacarpal bone in the hand which is aligned with the bones of the pinkie finger of the hand.

30. The protective glove in accordance with claim 26, wherein the flexible matrix of impact and shock absorbing cells are affixed and comprise a multiplicity of spaced apart impact and shock absorbing cells which are positioned on the exterior surface of the glove to cover additionally cover proximal phalanges, middle phalanges and distal phalanges bones of the pinkie finger.

31. The protective glove in accordance with claim 26, wherein the flexible matrix of impact and shock absorbing cells are affixed and comprise a multiplicity of spaced apart impact and shock absorbing cells which are positioned on the exterior surface of the glove to additionally cover the metacarpal bones of the hand aligned with the bones of the pinkie finger, fourth finger and middle finger.

32. The protective glove in accordance with claim 31, wherein the flexible matrix of impact and shock absorbing cells are affixed and comprise a multiplicity of spaced apart impact and shock absorbing cells which are positioned on the exterior surface of the glove to further cover additional bones of a wrist adjacent the hand including a lunate bone and a capitate bone.

33. The protective glove in accordance with claim 26 wherein the matrix of impact and shock absorbing cells on the glove are formed in spaced apart longitudinal rows and transverse rows, each shock absorbing cell separated from an adjacent shock absorbing cell by a gap to enhance flexibility of the glove.

34. The glove in accordance with claim 33 wherein each shock absorbing cell is generally rectangular in shape and at a location where four corners of adjacent shock absorbing cells face each other, the matrix of shock absorbing cells further comprises a shock absorbing post with a central opening.

35. The protective glove in accordance with claim 26, wherein each cell in the matrix of impact and shock absorbing cells is made of material selected from the group consisting of a soft polyvinyl chloride foam, soft polyvinyl chloride solid material, silicone foam, silicone solid material, flexible thermoplastic foam, flexible thermoplastic solid material, and flexible thermoplastic rubber.

36. The protective glove in accordance with claim 26, wherein the glove is shaped to be worn on the hand that is a right hand.

37. The protective glove in accordance with claim 26, wherein the glove is shaped to be worn on the hand that is a left hand.

38. A protective glove to be worn on a hand of a batter when gripping a baseball bat, the hand having at least a pinkie finger including bones, the hand having a metacarpal bone aligned with the pinkie finger of the hand, the hand extending to a wrist which includes bones, the protective glove comprising:

a. a body which covers at least the pinkie finger and at least a portion of the hand and wrist, the body having an exterior surface to which a flexible matrix of impact and shock absorbing cells are affixed and comprise a multiplicity of spaced apart impact and shock absorbing cells and circular shock absorbing posts having the respective central openings which are positioned on the exterior surface of the body, wherein said spaced apart impact and shock absorbing cells are greater in quantity and said circular shock absorbing posts are lesser in quantity, said cells cover at least the bones of the wrist which are metacarpal bone of the hand aligned with the bones of the pinkie finger.

39. The protective glove in accordance with claim 38, the body having an exterior surface to which a flexible matrix of impact and shock absorbing cells are affixed and comprise a multiplicity of spaced apart impact and shock absorbing cells which are positioned on the exterior surface of the body to additionally cover the metacarpal bone of the hand which is aligned with the bones of the pinkie finger.

40. The protective glove in accordance with claim 38 further comprising a substrate material sewn into the glove, a thermoplastic bonding layer bonded to the substrate layer, and the matrix of impact and shock absorbing cells bonded to the thermoplastic layer to protect at least the metacarpal bone in the hand which is aligned with the bones of the pinkie finger of the hand.

41. The protective glove in accordance with claim 38 further comprising a substrate material sewn into the glove, a thermoplastic bonding layer bonded to the substrate layer, and the matrix of impact and shock absorbing cells bonded to the thermoplastic layer to additionally protect bones on the wrist aligned with the metacarpal bone in the hand which is aligned with the bones of the pinkie finger of the hand.

42. The protective glove in accordance with claim 38, wherein the flexible matrix of impact and shock absorbing cells are affixed and comprise a multiplicity of spaced apart impact and shock absorbing cells which are positioned on the exterior surface of the glove to cover additionally cover proximal phalanges, middle phalanges and distal phalanges bones of the pinkie finger.

43. The protective glove in accordance with claim 38, wherein the flexible matrix of impact and shock absorbing cells are affixed and comprise a multiplicity of spaced apart impact and shock absorbing cells which are positioned on the exterior surface of the glove to additionally cover the metacarpal bones of the hand aligned with the bones of the pinkie finger, fourth finger and middle finger.

44. The protective glove in accordance with claim 38, wherein the flexible matrix of impact and shock absorbing cells are affixed and comprise a multiplicity of spaced apart impact and shock absorbing cells which are positioned on the exterior surface of the glove to further cover additional bones of a wrist adjacent the hand including a lunate bone and a capitate bone.

45. The protective glove in accordance with claim 44, wherein the flexible matrix of impact and shock absorbing cells are affixed and comprise a multiplicity of spaced apart impact and shock absorbing cells which are positioned on the exterior surface of the glove to further cover a portion of an ulna bone of an arm which is adjacent the bones of the wrist being protected by the glove.

46. The protective glove in accordance with claim 38 wherein the matrix of impact and shock absorbing cells on the glove are formed in spaced apart longitudinal rows and transverse rows, each shock absorbing cell separated from an adjacent shock absorbing cell by a gap to enhance flexibility of the glove.

47. The glove in accordance with claim 46 wherein each shock absorbing cell is generally rectangular in shape and at a location where four corners of adjacent shock absorbing cells face each other, the matrix of shock absorbing cells further comprises a shock absorbing post with a central opening.

48. The protective glove in accordance with claim 38, wherein each cell in the matrix of impact and shock absorbing cells is made of material selected from the group consisting of a soft polyvinyl chloride foam, soft polyvinyl chloride solid material, silicone foam, silicone solid material, flexible thermoplastic foam, flexible thermoplastic solid material, and flexible thermoplastic rubber.

49. The protective glove in accordance with claim 38, wherein the glove is shaped to be worn on the hand that is a right hand.

50. The protective glove in accordance with claim 38, wherein the glove is shaped to be worn on the hand that is a left hand.

* * * * *